US006357846B1

(12) United States Patent
Kitahara

(10) Patent No.: US 6,357,846 B1
(45) Date of Patent: Mar. 19, 2002

(54) INK JET RECORDING APPARATUS AND RECORDING METHOD USING THE SAME

(75) Inventor: Tsuyoshi Kitahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/358,729

(22) Filed: Jul. 22, 1999

(30) Foreign Application Priority Data

Jul. 22, 1998 (JP) ..... 10-206056

(51) Int. Cl.[7] ..... B41J 29/38
(52) U.S. Cl. ..... 347/10; 347/9; 347/11
(58) Field of Search ..... 347/9–11, 68

(56) References Cited

U.S. PATENT DOCUMENTS 4,266,232 A 5/1981 Juliana, Jr. et al. ..... 346/140 R
5,541,628 A 7/1996 Chang et al. ..... 347/10

FOREIGN PATENT DOCUMENTS

EP 0 782 924 A1 7/1997 ..... B41J/2/045
EP 0788882 A2 * 8/1997 ..... 347/10
EP 0 829 354 A1 3/1998 ..... B41J/2/045
JP 57-61576 4/1982 ..... B41J/3/04

OTHER PUBLICATIONS

Japanese Abstract No. 57061576, dated Apr. 14, 1982.

Japanese Abstract No. 09029996, dated Feb. 4, 1997.

* cited by examiner

*Primary Examiner*—John Barlow
*Assistant Examiner*—An H. Do
(74) *Attorney, Agent, or Firm*—Sughrue Mion, PLLC

(57) ABSTRACT

In order to prevent a viscosity of ink near each nozzle orifice of a recording head from increasing, a time to eject an ink drop therethrough is analyzed based on print data. Dot pattern data is generated by determining the printing period where the fine vibration should be applied to the meniscus of ink in each nozzle in accordance with analysis of the print data. Accordingly, remarkable suppression of the viscosity increase, stabilization of the flying path of the ink drop, and efficient flushing may be achieved without complexity of the whole machine construction.

19 Claims, 31 Drawing Sheets

FIG. 24 (a)
| SOLID CONTENT DENSITY | INK COLOR |
|---|---|
| HIGH | BLACK |
| MEDIUM | CYAN<br>MAGENTA |
| LOW | YELLOW<br>LIGHT CYAN<br>LIGHT MAGENTA |
FIG. 24 (b)
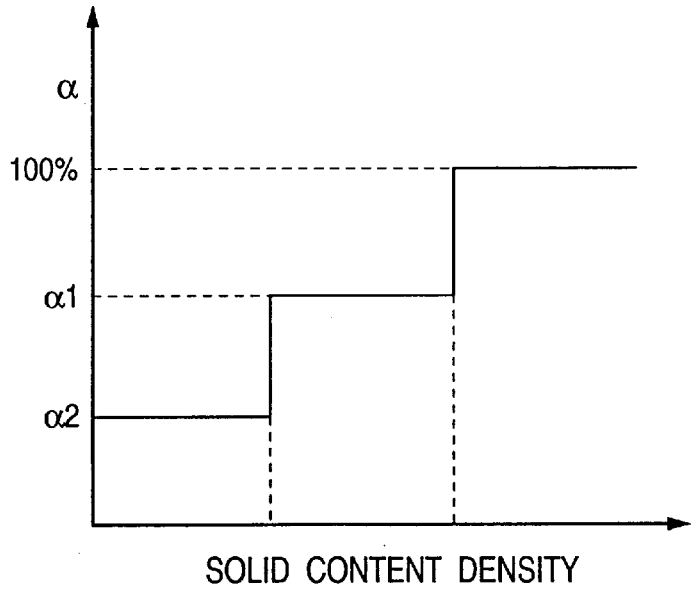
FIG. 24 (c)
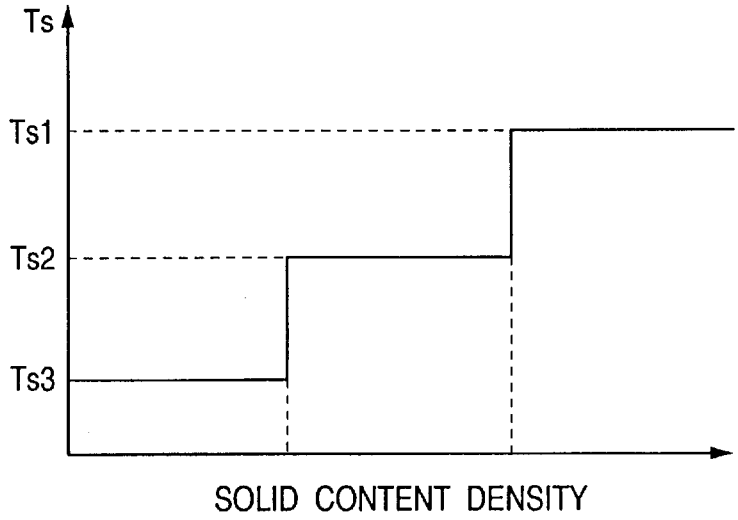

INK JET RECORDING APPARATUS AND RECORDING METHOD USING THE SAME

BACKGROUND OF THE INVENTION

The present invention relates to an ink jet recording apparatus and an ink jet recording method using the same. More particularly, the present invention relates to an ink jet recording apparatus and an ink jet recording method using the same, which prevents an increase of a viscosity of the ink in each nozzle of the recording head by vibrating the ink meniscus to such an extent as not to eject an ink drop.

As well known, the ink jet printer is provided with a recording head having a number of nozzles arrayed in a subscanning direction (vertical direction). To print, the recording head is moved in a main scanning direction (horizontal direction) by a carriage mechanism, and a printing medium, e.g., a printing paper, is fed or moved in the subscanning direction. The printer receives print data from a host computer connected thereto, develops the print data into dot pattern data, and drives the recording head, in accordance with the dot pattern data, to eject ink drops through orifices of the nozzles of the recording head at predetermined timings. Those ink drops land on a printing medium, such as a printing paper or an OHP sheet, to print characters, graphical objects and others on the printing medium.

To prevent ink bleeding, it is desirable that the ink drop is quickly dried and solidified. To this end, the ink is generally prepared so that its ink solvent quickly evaporates. It is a rare case that ink drops are ejected through all the nozzle orifices. In most cases, the recording head ejects ink drops toward predetermined or selected positions on the printing medium during a main scanning operation. Accordingly, each main scanning period includes ink ejection periods to eject ink drops and non-ejection periods to eject no ink drops. During the non-ejection period, each nozzle allows water to evaporate from the ink through its orifice, so that a viscosity of the ink increases (referred to frequently as a viscosity increase). The nozzles located at the top and bottom positions on the head face of the recording head are infrequently used when comparing with those nozzles located in the central portion on the head face. Therefore, in the top and bottom nozzles the non-ejection period is long, and those nozzles frequently suffer from the viscosity increase. The viscosity increase brings about many problems: the flying performance of the ejected ink drop is unstable, the nozzle is clogged with dried ink, and the print quality is deteriorated.

To prevent the nozzle clogging, the recording head is usually flushed under predetermined conditions. Specifically, the following operation is periodically performed. The recording head is retracted to a cleaning region, small amounts of ink drops are forcibly discharged from all the nozzles to refresh the ink located near the nozzle orifices.

When the recording head is flushed, the ink near the nozzle orifices is forcibly replaced with fresh ink. In this case, the forcibly discharged ink is wasted, leading to increase of print cost. Further, the flushing operation inevitably interrupts the printing operation. The interruption of the printing operation decreases the printing speed per page, and hence increases of the print time. In recent years, the color printing is widely used. In the circumstances, the nozzles of each color inevitably suffer from the viscosity increase problem.

A technique to refresh the ink near the nozzle orifice by finely vibrating the meniscus of ink during the main scanning operation as well as to forcibly discharge the ink is disclosed in Japanese Patent Publication 57-61576A, for example. To refresh the ink near the nozzle orifice, the technique applies fine pulse signals to the piezoelectric vibrators during the main scanning operation, to thereby finely vibrate the meniscus to such an extent as not to discharge the ink drop. Hereinafter, "fine vibration" means vibration whose amplitude do not eject ink from the nozzle orifices.

As described above, the related technique vibrates the meniscus to prevent the ink viscosity thereof from increasing. However, frequent operations of vibrating the meniscus urges the solvent of the ink to evaporate, possibly resulting in an increase of ink viscosity. Some time elapses till the vibration of the meniscus damps and the vibrating meniscus settles down. If the meniscus is finely vibrated just before an ink drop is ejected, the quantity, shape and a flying path of the ink drop will vary, deteriorating the print quality. The fine vibration influence on a viscosity of ink near the nozzle orifice depends on ambient temperature, aging of the ink and other factors. Application of a uniform fine vibration to the meniscus in circumstances where various related parameters vary from moment to moment will entail an excessive vibration of the meniscus. The excessive vibration leads to increase of the ink viscosity. Thus, it is safe to say that the related technique lacks relationships between the meniscus and the operating conditions of the nozzles (ink drop ejection time and position), ambient conditions and the like, and hence the related technique succeeds in presenting an insufficient solution to the viscosity increase problem.

SUMMARY OF THE INVENTION

Accordingly, an object of the present invention is to provide an ink jet recording apparatus and an ink jet recording method using the same which is free from the viscosity increase problem, and stabilizes a flying path of an ink drop ejected, with a unique and novel technical idea that the meniscus of ink in each nozzle is finely vibrated under the control based on the operating conditions of each nozzle.

To achieve the above object, an ink jet recording apparatus of the present invention is arranged such that operating conditions of each nozzle are analyzed in advance, and necessary fine vibration is applied to the meniscus of ink in each nozzle at necessary positions.

In order to achieve the above object, there is provided an ink jet recording apparatus comprising: a recording head provided with nozzles each from which an ink drop is ejected by operating associated pressure generating elements in accordance with inputted print data; driving signal generating means for generating a first driving signal and a second driving signal, the first driving signal for operating the pressure generating element so as to eject the ink drop, the second driving signal for operating the pressure generating element such an extent as to not eject the ink drop; data generating means for selecting at least one predetermined operation pattern for operating the pressure generating element in accordance with operating condition of each nozzle analyzed with reference to the print data in order to generate a dot pattern data in which the first and second data are arranged in accordance with the selected pattern; and switching means for inputting the first and second driving signals to the pressure generating element in accordance with the dot pattern data for each printing period.

The "pressure generating element" is an element capable of varying a pressure of ink in accordance with an input signal applied thereto, and is preferably a piezoelectric element which expands and contracts in accordance with an input signal. A heat generating element, which generates air bubbles when it is heated and varies a pressure of ink by the generated bubbles, may be used for the pressure generating element. The "second driving signal" may be a signal capable of finely vibrating the meniscus of ink to such an extent as to not eject an ink drop through the nozzle. It may take various energy levels and variation forms. The first and second data are typically expressed in terms of "1" or "0". When "1" is set to the print bit data (print bit data is made valid), the ink drop is ejected. When "0" is set to the first data (first data is made invalid), the ink drop is not ejected. When the second data is valid, a fine vibration is applied to the meniscus of ink (i.e., the meniscus is finely vibrated). When the second data is invalid, a fine vibration is not applied to the meniscus of ink (i.e., the meniscus is not vibrated). The "operating conditions of each nozzle" means an ink dot forming state by each nozzle, viz., a printing period where an ink drop is to be ejected.

When receiving print data from a word processor, a personal computer, a work station, a digital still camera or the like, the data generating means analyzes the operating conditions of each nozzle by use of the print data, and selects an operation pattern in accordance with the operating conditions analyzed. One or larger number of operation patterns may be stored. The data generating means sets the second data at predetermined positions in accordance with a selected operation pattern, to thereby generate a dot pattern data. The second data is set to "1" during a printing period where a fine vibration is to be applied to the ink meniscus of those printing periods of one main scanning. The second data is set to "0" during a printing period where a fine vibration is to not be applied to the ink meniscus.

The thus generated operation pattern data is input to the switching means. When the second data is "1", the switching means allows the first driving signal, which is generated by the driving signal generating means, to go to the pressure generating element. The pressure generating element vibrates at such an amplitude as not to eject an ink drop, and the meniscus of ink in the nozzle associated with the vibrating pressure generating element finely vibrates to refresh ink. When the second data is "0", the switching means prohibits the second driving signal from going to the pressure generating element. When the first data is "1", the switching means allows the first driving signal to go to the pressure generating element to eject an ink drop. When it is "0", the switching means prohibits the first driving signal from going to the pressure generating element.

Therefore, necessary fine vibration is applied to the meniscus of ink in each nozzle when the fine vibration is needed, in accordance with the operating conditions of each nozzle. Therefore, the ink jet recording apparatus prevents an increase of ink viscosity and stabilize a flying path of the ink drop.

In the thus constructed ink jet recording apparatus, the predetermined operation pattern includes a first operation pattern for generating the dot pattern data in which the second data is set so as to select the second driving signal at a predetermined frequency in the printing period except for a predetermined period preceding to a printing period where the first driving signal is selected. In the first operation pattern, when an ink drop is ejected at a position, the fine vibration is not applied to the ink meniscus during the printing periods for a predetermined period immediately before an ink drop is ejected, but the fine vibration is applied to the meniscus during other printing periods than the printing periods. To be more specific, it is assumed now that a total number of printing periods contained in one main scanning period is N, and that the predetermined period consists of three printing periods. When an ink drop is ejected at the n-th printing period, the meniscus is not vibrated during three consecutive printing periods, i.e., the (n−1)th to (n−3)th printing periods, but it is vibrated at a predetermined frequency during other printing periods than the former periods, viz., the first to (n−4)th printing periods, and the n-th period to Nth period. This instance is valid where the first driving signal first appears and the second driving signal then appears during one main scanning period. Where the second driving signal first appears and then the first driving signal appears during one main scanning period, the fine vibration is stopped at a second driving signal present in the same printing period as of a first driving signal selected to eject an ink drop, or the n-th printing period, and the subsequent ones. Therefore, the vibration of the meniscus is damped before the ink ejection, so that a flying path of the ink drop is stabilized. The "at a predetermined frequency" means that the meniscus is vibrated during all the printing periods in which the second driving signal is permitted to be selected (frequency=100%), and that the meniscus may be vibrated every other printing period (frequency=50%).

In the ink jet recording apparatus, the predetermined operation pattern includes a second operation pattern for generating the dot pattern data in which the second data is not set for a first period preceding to a printing period where the first driving signal is selected, and the second data is set so as to select the second driving signal at a predetermined frequency for a second period preceding to the first period.

In the second operation pattern, when an ink drop is ejected at a position, the fine vibration is not applied to the ink meniscus during the printing periods during a first period immediately before an ink drop is ejected, but the fine vibration is applied to the meniscus during a second time period preceding to the first period. This will be described in more detail by using a case where the first period consists of three printing periods, the second period consists of five printing periods, and an ink drop is ejected at the n-th printing period. In this case, no fine vibration is performed during three consecutive printing periods, i.e., the (n−1)th to (n−3)th printing periods, within the first period. The fine vibration is applied to the meniscus at a predetermined frequency during the five consecutive printing periods, or the (n−4)th to (n−8)th printing periods. No fine vibration is not applied to the meniscus during the first to (n−9)th printing periods, and n-th and latter printing periods. Therefore, there is no chance that the flying path of the ink drop is unstable, and that unnecessary fine vibration is applied to the meniscus.

The first and second period may be set even in an accelerating region where the recording head is accelerated moved.

The carriage mechanism drives the recording head at a stand-by position in a region out of a print region to move in an accelerating manner. When the thus moved recording head reaches a print reference position, it moves at a constant speed. Thus, the second data is applied to this region out of the print region. This feature prevents the viscosity increase even when the ink drop is ejected at the first printing period.

The predetermined operation pattern includes a third operation pattern for generating the dot pattern data in which the second data is not set for a first period subsequent to a printing period where the first driving signal is selected, and the second data is set so as to select the second driving signal at a predetermined frequency for a second period subsequent to the first period.

In the third operation pattern, the fine vibration is applied to the meniscus during the second period spaced from the ink ejection by the first period. This will be described in more detail by using a case where the first period consists of three printing periods, the second period consists of five printing periods, and ink ejection is performed at the n-th printing period. In this case, no fine vibration is applied to the meniscus during three consecutive printing periods, or the n-th to (n+2)th printing periods, while the fine vibration is applied at a predetermined frequency to the meniscus during five consecutive printing periods, or the (n+3)th to (n+7)th printing periods. This feature eliminates an unnecessary vibration of the meniscus immediately after the ink drop is ejected and ink is refreshed, and finely vibrates the meniscus to refresh the ink when evaporation of the solve of the refreshed ink will start.

The predetermined operation pattern includes a fourth operation pattern for generating the dot pattern data in which the second data is set so as to periodically select the second driving signal at a predetermined frequency with respect to a nozzle of which no ink drop is ejected within one main scanning.

In the fourth operation pattern, the fine vibration is periodically applied at a predetermined frequency to the meniscus of ink in a nozzle of which no ink drop is ejected within one main scanning. Such a resting nozzle is frequently found in the upper and lower regions of the head face of the recording head. Typically, in the called interlace drive method, the upper nozzle in the upper end processing is likely to rest, and the lower nozzle in the lower end processing is likely to rest. The upper and lower nozzles are frequency positioned in regions out of the print region. Accordingly, it is frequent that those nozzles do not eject ink drops during one main scanning period. Therefore, a viscosity of ink tends to increase at and near the orifices of those nozzles. The fine vibration is periodically applied to those resting nozzles, to prevent the viscosity increase.

At least one of the predetermined frequency and the period of which the second data is set is variably determined according to ambient temperature.

Parameters, e.g., viscosity of ink, varies depending on the ambient temperature. Therefore, the vibrating period and the predetermined frequency depend on ambient temperature. To cope with this, those are adjusted in accordance with ambient temperature. For example, the frequency for fine vibration is reduced where ambient temperature is high. The temperature may directly be detected by use of a temperature sensing element, e.g., a thermister, mounted on a main control board or the recording head. Further, an accumulative operation may also be used to know ambient temperature.

Namely, it may be configured that the longer period is set in accordance with the lower ambient temperature, or the higher frequency is set in accordance with the lower ambient temperature.

At least one of the predetermined frequency and the period of which the second data is set is variably determined according to a viscosity of the ink.

A viscosity of ink contained in an ink cartridge (or ink tank) will increase since the solvent of the ink evaporates out through the container. Usually, the ink cartridge is made of a material permitting water vapor to transmit therethrough, polyethylene, polyacetal or ABS resin. Therefore, with the lapse of time after the cartridge is installed to the printer, the solvent of the ink gradually evaporates and dissipates through the cartridge, and the ink viscosity gradually increases. A viscosity variation may be obtained by estimating empirically a variation of the ink viscosity with time since installation of cartridge. The vibrating period and the frequency are adjusted by use of the estimated viscosity. For example, the time of applying the fine vibration or the frequency may be increased, as the ink viscosity within the cartridge increases.

Namely, it may be configured that the longer period is set in accordance with longer time since installation of an ink cartridge, or the higher frequency is set in accordance with longer time since installation of an ink cartridge.

At least one of the predetermined frequency and the period of which the second data is set is variably determined according to a solid content density of the ink.

The "solid content density" means a density of a coloring material in color ink. Generally, a solid content density of black ink is higher than that of other color inks. Dark or thin color ink of, for example, yellow, light cyan or light magenta, is low in solid content density. When the ink whose solid content density is relatively high is compared with the ink whose solid content density is relatively low, the former increases its viscosity at higher frequency. Accordingly, necessary vibrating period and frequency depends in value on the solid content density of the ink. Those period and frequency may be adjusted by use of the solid content density gathered in advance.

It may be configured that the longer period is set in accordance with the higher solid content density, or the higher frequency is set in accordance with the higher solid content density.

According to the present invention, there is also provided an ink jet recording method for operating a pressure generating element to eject an ink drop from each of nozzles provided in a recording head, comprising the steps of: analyzing an operation condition of each nozzle based on inputted print data; selecting at least one predetermined operation pattern in accordance with the analyzed operation condition; generating a dot pattern data in which a fine-vibration data for operating the pressure generating element such an extent as to not eject the ink drop is set at a predetermined position therein; and inputting the dot pattern data into the pressure generating element.

This ink jet recording method also produces useful effects comparable with those by the ink jet recording apparatus.

According to the present invention, there is also provided a computer-readable recording medium including a computer program for causing an ink jet recording apparatus, which comprises a pressure generating element operated to eject an ink drop from each of nozzles provided in a recording head, to execute the functions of: analyzing an operation condition of each nozzle based on inputted print data; selecting at least one predetermined operation pattern in accordance with the analyzed operation condition; generating a dot pattern data in which a fine-vibration data for operating the pressure generating element such an extent as to not eject the ink drop is set at a predetermined position therein; and inputting the dot pattern data into the pressure generating element.

The "recording medium" may be any of various semiconductor memory, e.g., ROM or RAM, a floppy disc, a hard disc, a magneto-optical disc, a magnetic tape, an IC card, and the like. Alternatively, communication mean may be used. In this case, necessary programs are down-loaded from a remote location by way of a communication line.

A computer of the ink jet recording apparatus reads a given program from the recording medium; analyzes operating conditions of each nozzle by use of print data; selects a proper operation pattern in accordance with the analysis result; and generates operation pattern data of which the second data is configured according to the selected operation pattern. Therefore, necessary fine vibration may be applied to the meniscus of ink at necessary time points in accordance with the operating conditions, thereby preventing the viscosity increase and stabilizing the flying path of the ink drop.

BRIEF DESCRIPTION OF THE DRAWINGS

In the accompanying drawings:

FIG. 24(*a*) is a table for explaining a relation between a solid content density and a color of ink, FIGS. 24(*b*) and (*c*) show a reference map for the vibrating ratio and a reference map for the vibrating period, respectively in connection with the solid content density;

DETAILED DESCRIPTION OF THE PREFERRED EMBODIMENTS

The preferred embodiments of the present invention will be described with reference to the accompanying drawings.

Figure 1:
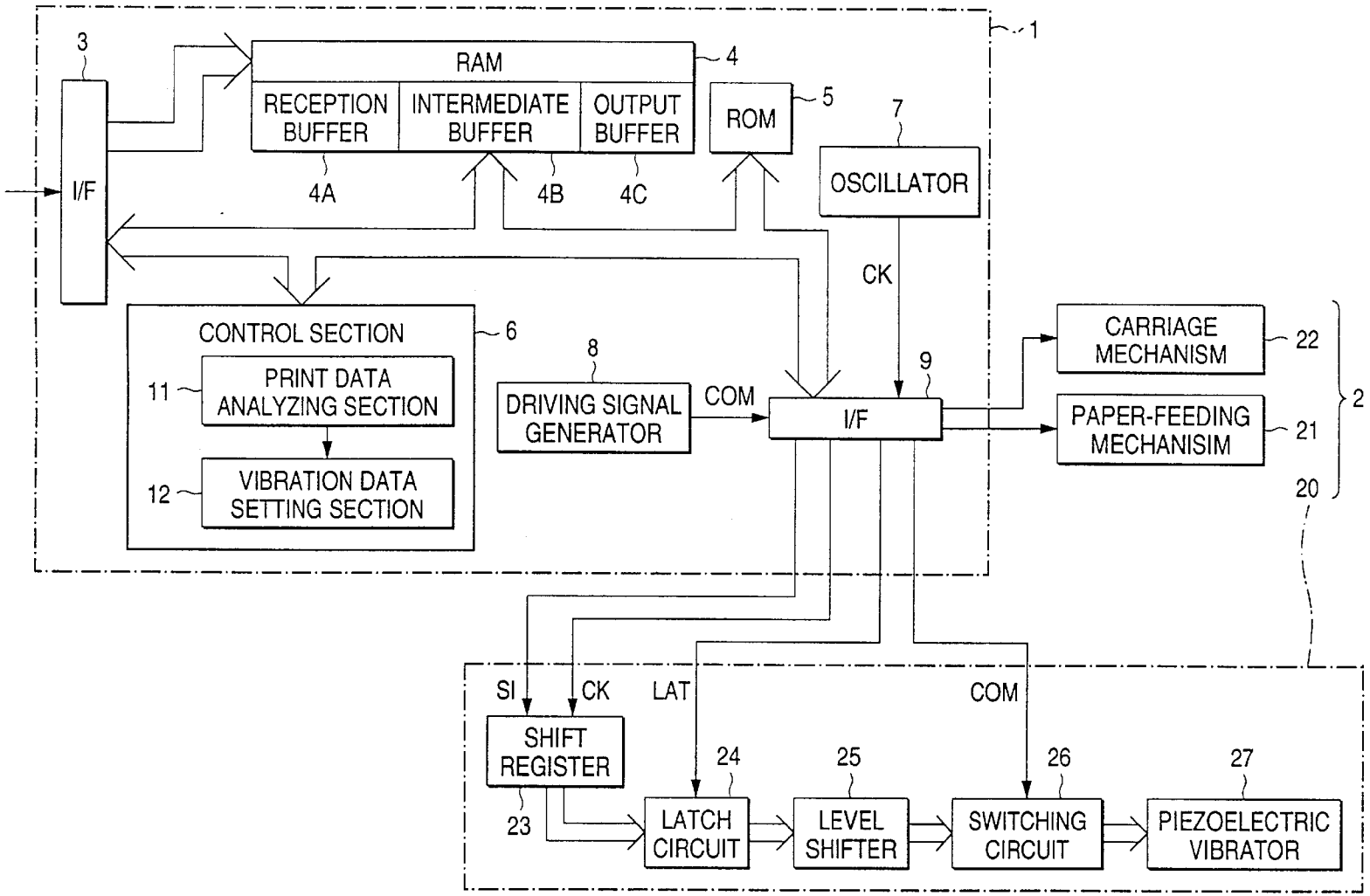
FIG. 1 is a block diagram showing a whole configuration of an ink jet printer of the present invention.

FIG. 1 is a functional block diagram showing a whole configuration of an ink jet printer (an ink jet recording apparatus) according to a first embodiment of the present invention.

As shown, an ink jet printer includes a print controller 1 and a print engine 2. The print controller 1 is made up of an interface (I/F) 3 for receiving print data from a host computer (not shown), a RAM 4 for storing various data, a ROM 5 for storing programs for various data processings, a control section 6 including mainly a CPU, an oscillator 7, a driving signal generator 8 (driving signal generating means) for generating driving signals for transfer to a recording head 20 to be described later, and an I/F 9 for transmitting print data as dot pattern data (bit map data), driving signals and the like to the print engine 2.

The I/F 3 receives one of character code, graphic function and image data, or print data consisting of a plurality of data. The I/F 3 also outputs a busy (BUSY) signal, an acknowledge signal (ACK), and others.

The RAM 4 is used for a reception buffer 4A, an intermediate buffer 4B, an output buffer 4C, a work memory (not shown), and others. The reception buffer 4A receives print data from the host computer through the I/F 3, and temporarily stores it therein. The intermediate buffer 4B stores intermediate code data, which results from a conversion of the print data into an intermediate code, which is carried out by the control section 6. Ejection data and vibration data are developed as dot pattern data into the output buffer 4C, as will be described later. The ejection data is "print bit data" for causing the recording head to eject ink drops through the nozzles. The vibration data is "vibration bit data" for finely vibrating meniscuses of ink within the nozzles of the recording head. The ROM 5 stores various types of control routines, font data, graphic functions, various procedures and others (executed by the control section 6).

The control section 6 (data generating means) reads out print data from the reception buffer 4A, and converts it into intermediate code data and loads the resultant into the intermediate buffer 4B. The control section 6 analyzes the intermediate code data, which is read out of the intermediate buffer 4B, and converts the intermediate code data into dot pattern data while referring to font data, graphic functions and others, which are stored in the ROM 5. The control section 6 functionally includes a print data analyzer 11 and a vibration data setting section 12. The print data analyzer 11 analyzes the print data to detect operating conditions of the nozzles. The vibration data setting section 12 sets the vibration data on the basis of the analysis result so as to provide an appropriate fine vibration of the meniscus of the ink within each nozzle at a proper position on a print line. The control section 6 analyzes, every main scanning operation, the print data to specify a position on a print line at which a dot is to be formed by an ink drop ejected from each nozzle of each color, and determines a fine vibration to be applied to the meniscus of the ink in each nozzle of the recording head in connection with the dot forming position. The dot pattern data generated by the control section 6 is arranged such that it consists of ejection data and vibration data for each printing period, and is stored in the output buffer 4C.

When the amount of data in the output buffer 4C reaches the dot pattern data of one line of the recording head 20, the one-line dot pattern data is serially transferred to the recording head 20, through the I/F 9. After the output buffer 4C outputs one-line dot pattern data, the intermediate buffer 4B is erased and the next conversion of the print data to intermediate codes is performed by the control section 6.

The print engine 2 includes the recording head 20, a paper feeding mechanism 21 and a carriage mechanism 22. The paper feeding mechanism 21 is formed with a paper feed motor, paper feed rollers and other related components, and successively feeds a printing medium, such as a printing paper, in the subscanning direction. The carriage mechanism 22 includes a carriage for mounting the recording head 20 thereon, a carriage motor for moving the carriage by means of a timing belt, and other related components. The carriage mechanism 22 moves the recording head 20 in the main scanning direction.

The recording head 20 includes a number of nozzles arrayed in the subscanning direction, and ejects ink drops out of the selected nozzle orifices at predetermined timings. The print data, which now takes the form of dot pattern data, is serially transferred through the I/F 9 to a shift register 23 in synchronism with a clock signal (CK) output from the oscillator 7. Then, the print data (SI) is transferred to a latch circuit 24 in which it is latched therein.

The print data output from the latch circuit 24 is applied to a level shifter 25 as a voltage amplifier in which the print data signal is amplified to a predetermined voltage level of several tens volts, for example. The print data signal thus amplified is then applied to a switching circuit 26 (switching means). A driving signal (COM) is applied from the driving signal generator 8 to the input of the switching circuit 26. A piezoelectric vibrator 27 (pressure generating element) is connected to the output of the switching circuit 26.

The print data controls an operation of the switching circuit 26 in the following manner. During a time period that the data applied to the switching circuit 26 is "1", a driving signal is applied to the piezoelectric vibrator 27, so that the vibrator is expanded and contracted or shrunk in response to the driving signal. During a period of period that the data applied is "0", a driving signal that is applied to the piezoelectric vibrator 27 is interrupted.

Figure 2:
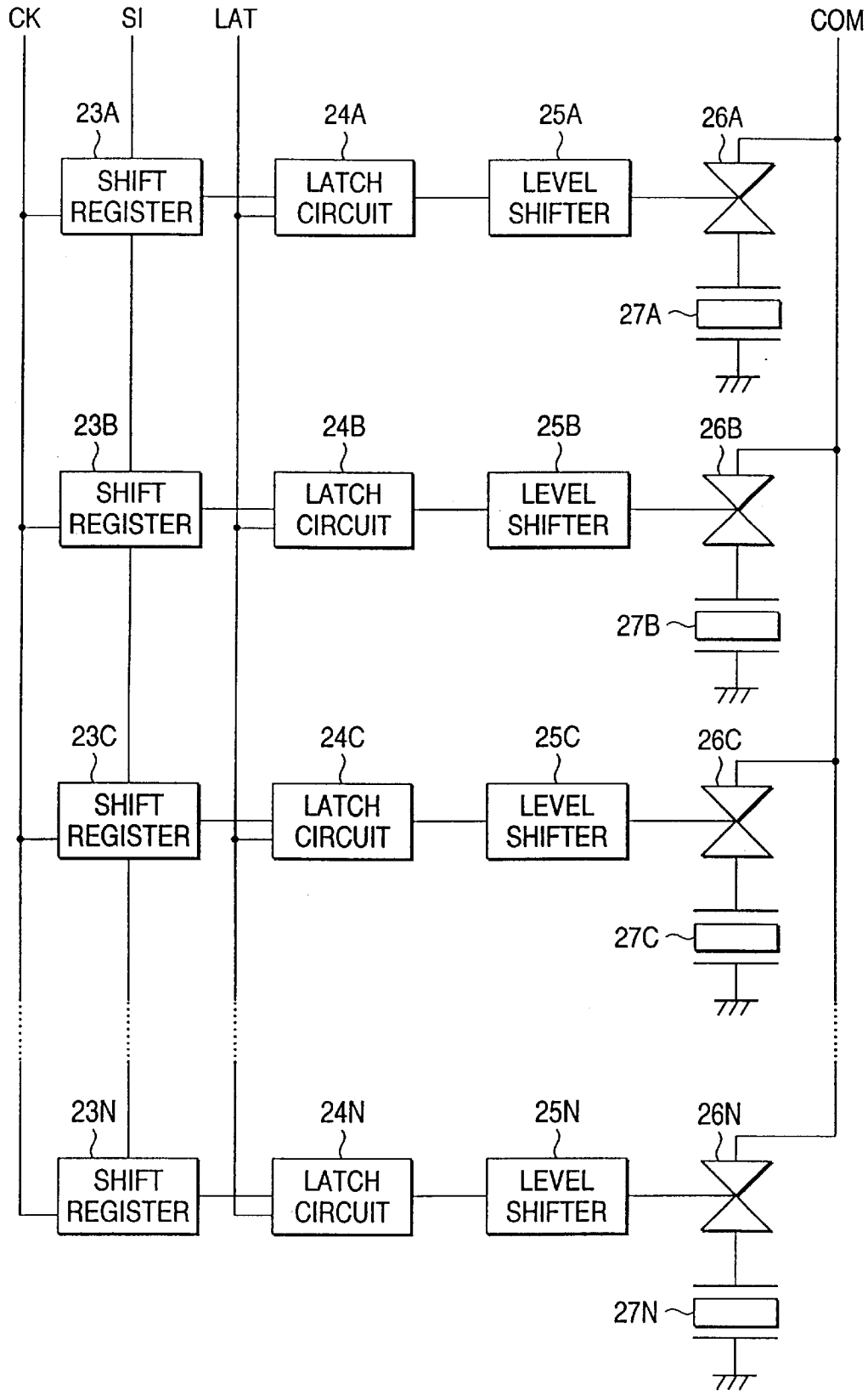
FIG. 2 is a circuit diagram showing a main part of a recording head driving circuit of the ink jet printer.

A specific circuit diagram incorporated into the recording head 20 is shown in FIG. 2. As shown, the shift register 23 is formed with shift register elements 23A to 23N; the latch circuit 24 is formed with latch elements 24A to 24N; the level shifter 25 is formed with level shifter elements 25A to 25N; the switching circuit 26 is formed with switching elements 26A to 26N; and the piezoelectric vibrator 27 is formed with vibrator elements 27A to 27N. The print data consists of two bits, such as (10) and (01) for each nozzle. The higher order bit represents ejection data, and the lower order bit represents vibration data. The bit data of the respective digits for all the nozzles are input to the shift register elements 23A to 23N during one printing period.

The data of the higher order bits for all the nozzles are serially transferred to the shift register elements 23A to 23N, and then latched in the latch elements 24A to 24N. Then, the data of the lower order bits for all the nozzles are serially transferred to the shift register elements 23A to 23N.

When the bit data applied to the switching elements 26A to 26N as analog switching elements are "1" in logical state, a driving signal (COM) is directly applied to the vibrator elements 27A to 27N, and the vibrator elements 27A to 27N displace in accordance with a waveform of the driving signal, viz., with an amplitude variation of the driving signal. When the bit data applied to the switching elements 26A to 26N as analog switching elements are "0" in logical state, a driving signal (COM) applied to the vibrator elements 27A to 27N is interrupted, and those vibrator elements hold quantities of previous charge.

Figure 3:
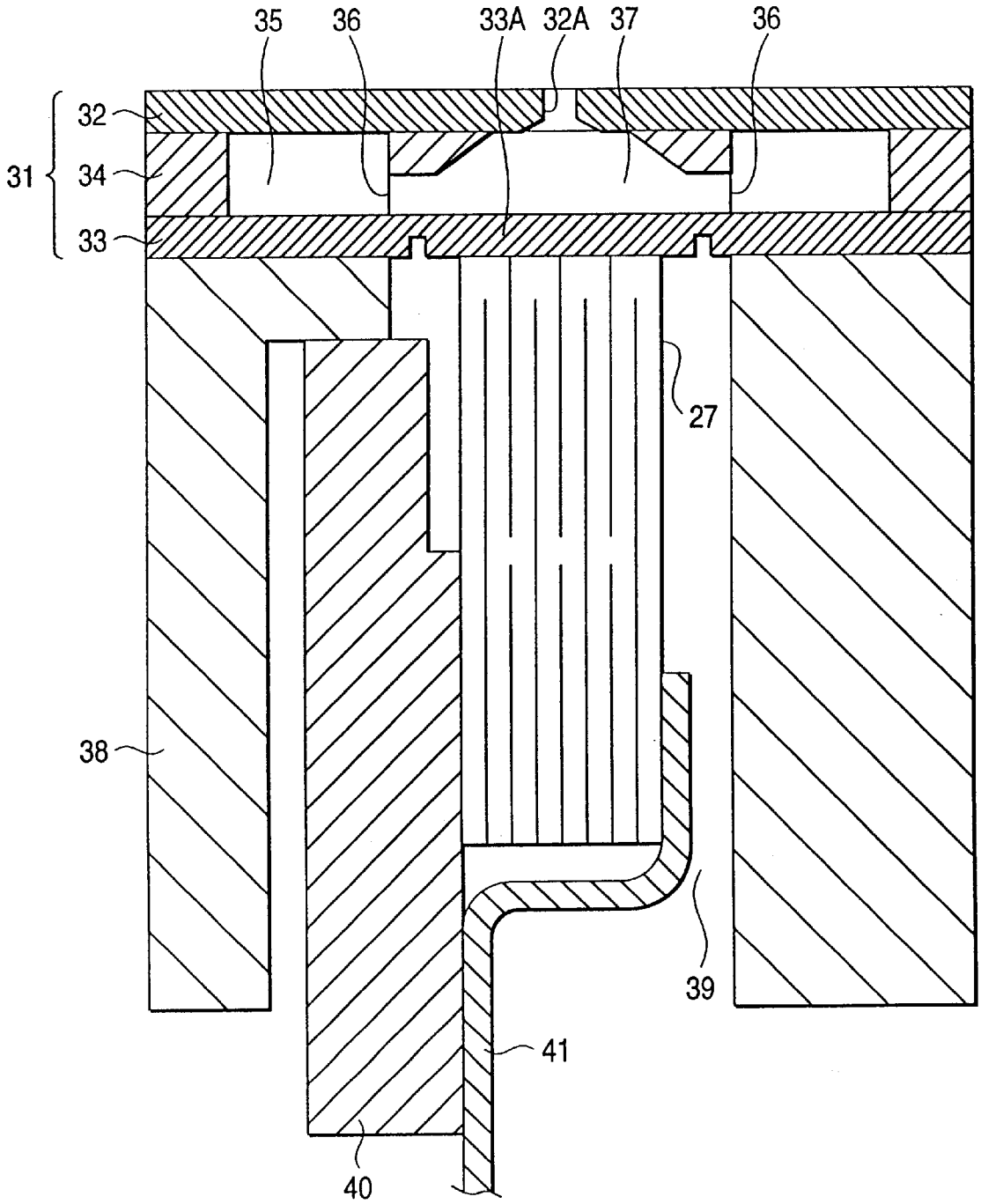
FIG. 3 is a sectional view showing a mechanical arrangement of a recording head of the ink jet printer.

A mechanical arrangement of the recording head 20 is shown in FIG. 3. A substrate unit 31 is constructed with a nozzle plate 32 with nozzle orifices 32A formed therein, a vibrating plate 33 with island portions 33A formed therein, and a passage forming plate 34 sandwiched between the nozzle plate 32 and the vibrating plate 33.

A chamber 39 is formed in a base plate 38. A piezoelectric vibrator 27 (more precisely any of the vibrator elements 27A to 27N) is placed in the chamber 39. Within the chamber 39, the piezoelectric vibrator 27 is disposed such that the upper end of the piezoelectric vibrator 27 is in contact with the island portion 33A of the vibrating plate 33 and fixed with a fixing substrate 40. The piezoelectric vibrator 27 is a PZT of the longitudinal vibration, lateral effect type. This type of the PZT is contracted when it is charged, and expanded when it is discharged. A lead wire 41 is connected to the piezoelectric vibrator 27 for its charging and discharging.

The piezoelectric vibrator 27 may also be of the flexural vibration type. This type of the piezoelectric vibrator is contracted when it is charged, while it is expanded when it is discharged. The piezoelectric vibrator 27 may be any of other electromechanical transducing elements than the PZT. An example of such an electromechanical transducing element is a magnetostrictive element. The function of each of those electromechanical transducing elements in the printer may be realized in such a manner that ink is heated by a heat source, e.g., a heater to generate air bubbles, and a pressure for discharging ink in the form of an ink drop is generated by the utilization of air bubbles. The piezoelectric vibrator 27 may be any type of vibrating element if it is capable of causing a variation of pressure within the pressure generating chamber 37 in accordance with an electrical signal applied thereto.

When the piezoelectric vibrator 27 is charged, it is shrunk; a pressure generating chamber 37 is expanded; a pressure within the pressure generating chamber 37 decreases; and ink flows from an ink reservoir 35 into the pressure generating chamber 37. When the piezoelectric vibrator 27 is discharged, it is expanded; a pressure generating chamber 37 is contracted; a pressure within the pressure generating chamber 37 increases; and ink is jetted in the form of an ink drop from the pressure generating chamber 37, through the nozzle orifice 32A.

Figure 4:
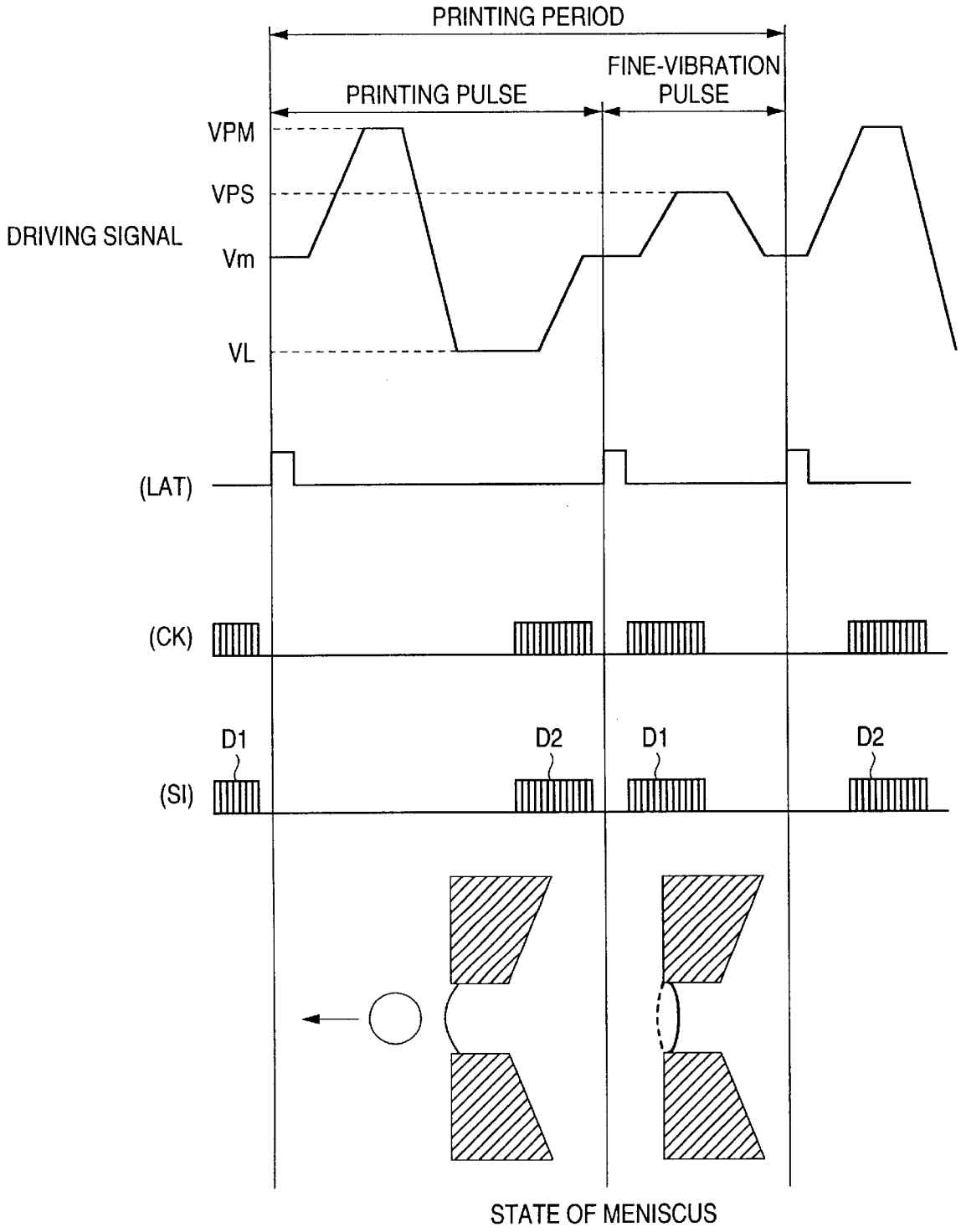
FIG. 4 is a diagram showing a relationship between a driving signal according to a first embodiment of the present invention applied to the recording head and a behavior of a meniscus of ink at a nozzle orifice of the recording head when it receives the driving signal.

A relationship between a driving signal applied to the recording head and a behavior of a meniscus of ink at a nozzle orifice of the recording head when it receives the driving signal is shown in FIG. 4. A driving signal (the uppermost waveform in the figure) output from the driving signal generator 8 is configured in waveform such that the driving signal consists of a printing pulse component and a fine-vibration pulse component during each period (printing period). The printing pulse component of the driving signal will be referred to as a "printing pulse", and the fine-vibration pulse component will be referred to as a "fine-vibration pulse".

As shown, a waveform of the printing pulse of the driving signal is configured: a voltage amplitude of the driving signal, which is continued from a previous fine-vibration pulse, increases from an intermediate voltage Vm to a maximum voltage VPM; it maintains the maximum voltage VPM for a short time period; it decreases to a minimum voltage VL; it maintains the minimum voltage VL for another short time period; and it increases to the intermediate voltage Vm, which is continued to a fine-vibration pulse. The minimum voltage VL is preferably selected to be equal to a ground level or somewhat higher than the ground level in the positive direction in order to avoid the polarization reversal thereof. Further, it is preferable that a descending slope (VPM→VL) (referred to as a "discharging slope") of the printing pulse for discharging the piezoelectric vibrator 27 is steeper than an ascending slope (Vm→VPM) (referred to as a "charging slope") of the printing pulse for charging the piezoelectric vibrator 27. When the printing pulse thus configured in waveshape reaches the piezoelectric vibrator 27, a meniscus in the nozzle orifice 32A is outwardly curved and an ink drop of a given volume separates from the meniscus and flies away outward (the left side of the lowermost view of FIG. 4).

The fine-vibration pulse is configured in waveshape: its voltage amplitude, which is continued from the end of the printing pulse, increases up to a second maximum voltage VPS; it maintains the second maximum voltage VPS for a short time period; and it decreases to the intermediate voltage Vm, which is continued to the next printing pulse. The second maximum voltage VPS is lower than the maximum voltage VPM of the printing pulse. An ascending slope (Vm→VPM) (referred to as a "charging slope") of the fine-vibration pulse for charging the piezoelectric vibrator 27 is selected to be substantially equal to a descending slope (VPS→Vm) (referred to as a "discharging slope") for discharging the same. When the fine-vibration pulse thus configured in waveshape is applied to the piezoelectric vibrator 27, the meniscus is somewhat moved inward and then outward, and no ink drop is ejected from the nozzle orifice. Thus, the fine-vibration pulse charges and discharges the piezoelectric vibrator 27 by a low voltage. Therefore, a pressure variation within the pressure generating chamber 37 is relatively gentle, so that the resultant pressure variation is capable of vibrating the meniscus, but is incapable of ejecting an ink drop. With the vibration of the meniscus, ink present near the nozzle orifice 32A is replaced with fresh ink, to thereby prevent an increase of a viscosity of the ink.

The transfer timings of the print data (dot pattern data) will be described. An ink drop can be ejected or the meniscus of ink can be finely vibrated at a desired position on a print line by synchronizing the generation of the printing pulse and the fine-vibration pulse with the transferring of the ejection data and the vibration data. The higher order bit data (ejection data) D1 for each color nozzle is transferred to and latched in the recording head 20 at a time point before the printing pulse is generated, and the switching circuit 26 is operated at the start of the printing pulse. The ejection data of "1" or "0" is input to the switching circuit 26, a nozzle orifice to be used for ink-drop ejection ejects an ink drop, while a nozzle to not be used is at rest. Similarly, the lower order bit data (vibration data) D2 for each color nozzle is transferred to and latched in the recording head 20 at a time point before a fine-vibration pulse is generated, and the vibration data is input to the switching circuit 26 at the start of the fine-vibration pulse. In a nozzle which receives the vibration data of "1", a meniscus therein is finely vibrated, and in a nozzle which receives the vibration data of "0", a meniscus therein is not vibrated.

Figure 5:
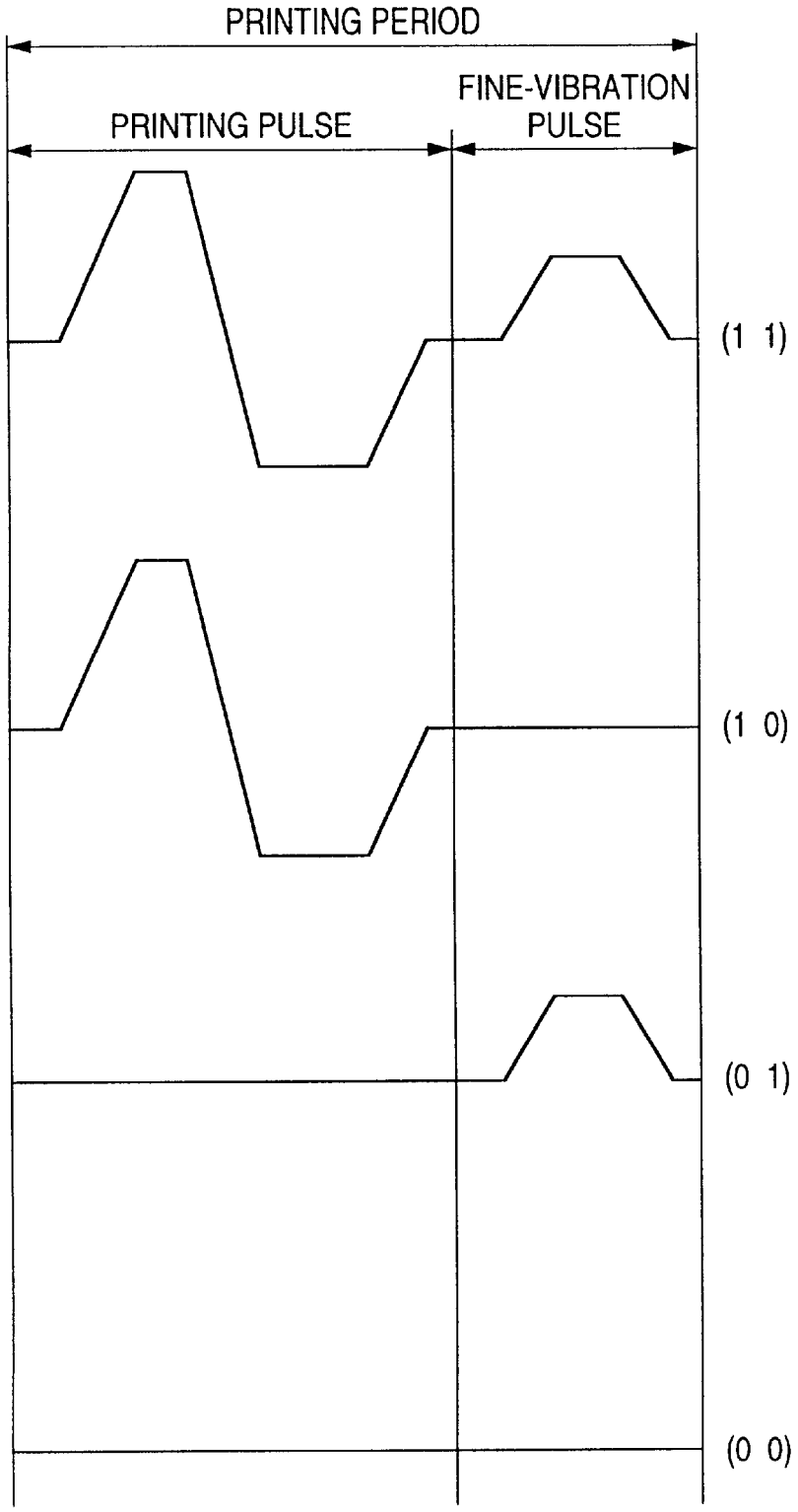
FIG. 5 is a waveform diagram showing how a printing pulse and/or a fine-vibration pulse, which are contained in a driving signal, is selected in accordance with print data in a printing period.

Reference is made to FIG. 5. When the print data of a printing period is "11", a printing pulse and a fine-vibration pulse are both input to the piezoelectric vibrator 27. During this printing period, the nozzle ejects an ink drop and a meniscus of ink within the nozzle is finely vibrated. When the data of a printing period is "10", a printing pulse is input to the piezoelectric vibrator 27, and a fine-vibration pulse is not applied thereto. Accordingly, the nozzle ejects an ink drop, but a meniscus of ink therein is not vibrated. When the data of a printing period is "01", a printing pulse is not input to the piezoelectric vibrator 27, but a fine-vibration pulse is applied thereto. Accordingly, the nozzle ejects no ink drop, but a meniscus of ink therein is finely vibrated. When the data of a printing period is "00", neither ejection of the ink drop or vibration of the meniscus is carried out.

An operation of the ink jet printer thus constructed will be described with reference to FIGS. 6 to 8. A flow chart shown in FIG. 6 shows a vibration data setting process for finely vibrating the meniscus of ink in each nozzle in accordance with print data of each print line.

In the flow chart, in a step (represented simply by S) 1, the control section 6 (referred to simply as a controller frequently) sets a first nozzle (i.e., a first print line) for printing and reads luster image data of the set print line (S2). The controller analyzes the image data of the print line, and detects a printing period to be used for forming a print dot, and sets vibration data for meniscus vibration on the basis of the result of the analysis (S3). Specifically, the vibration data is set so as to inhibit a fine vibration of the meniscus of ink within each nozzle for a predetermined number of printing periods preceding to the dot formation, but it permits the fine vibration of the meniscus during other printing periods than the vibration-inhibiting printing periods (hereinafter, referred to as a first vibrating pattern). The details of the setting of the vibration data will be described later in connection with FIG. 7.

The controller judges as to whether or not the vibration data has been set for all the nozzles (S4). If the data settings of all the nozzles are not yet completed, the controller sets the vibration data for the next nozzle number (S5), and returns to the step S2. When the data settings for all the nozzles have been completed through the repetitive executions of the sequence of the steps S2 to S5, the controller ends the vibration data setting process. Subsequently, the meniscus in each nozzle is finely vibrated as instructed by the thus set vibration data every main scanning operation.

Figure 6:
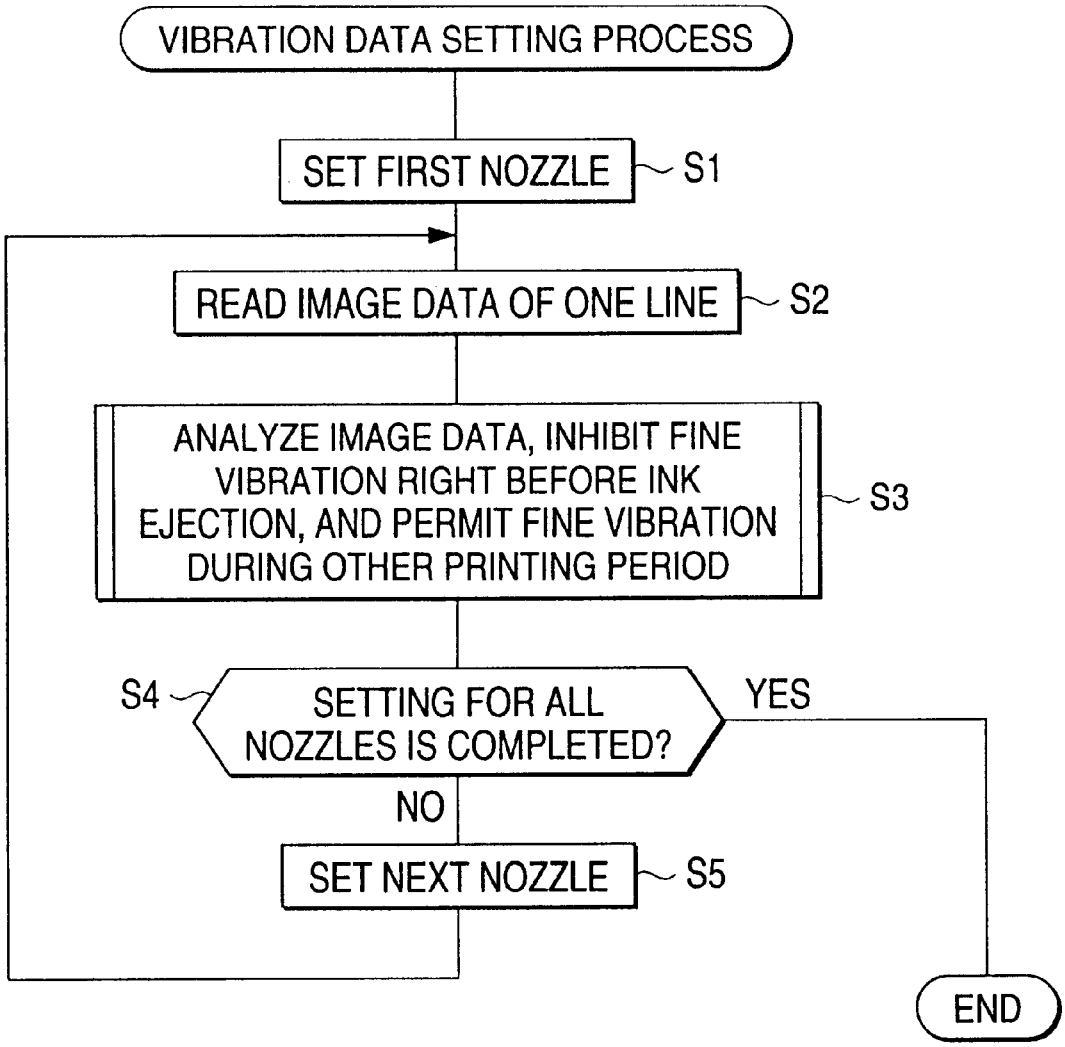
FIG. 6 is a flow chart showing a vibration data setting process.
Figure 7:
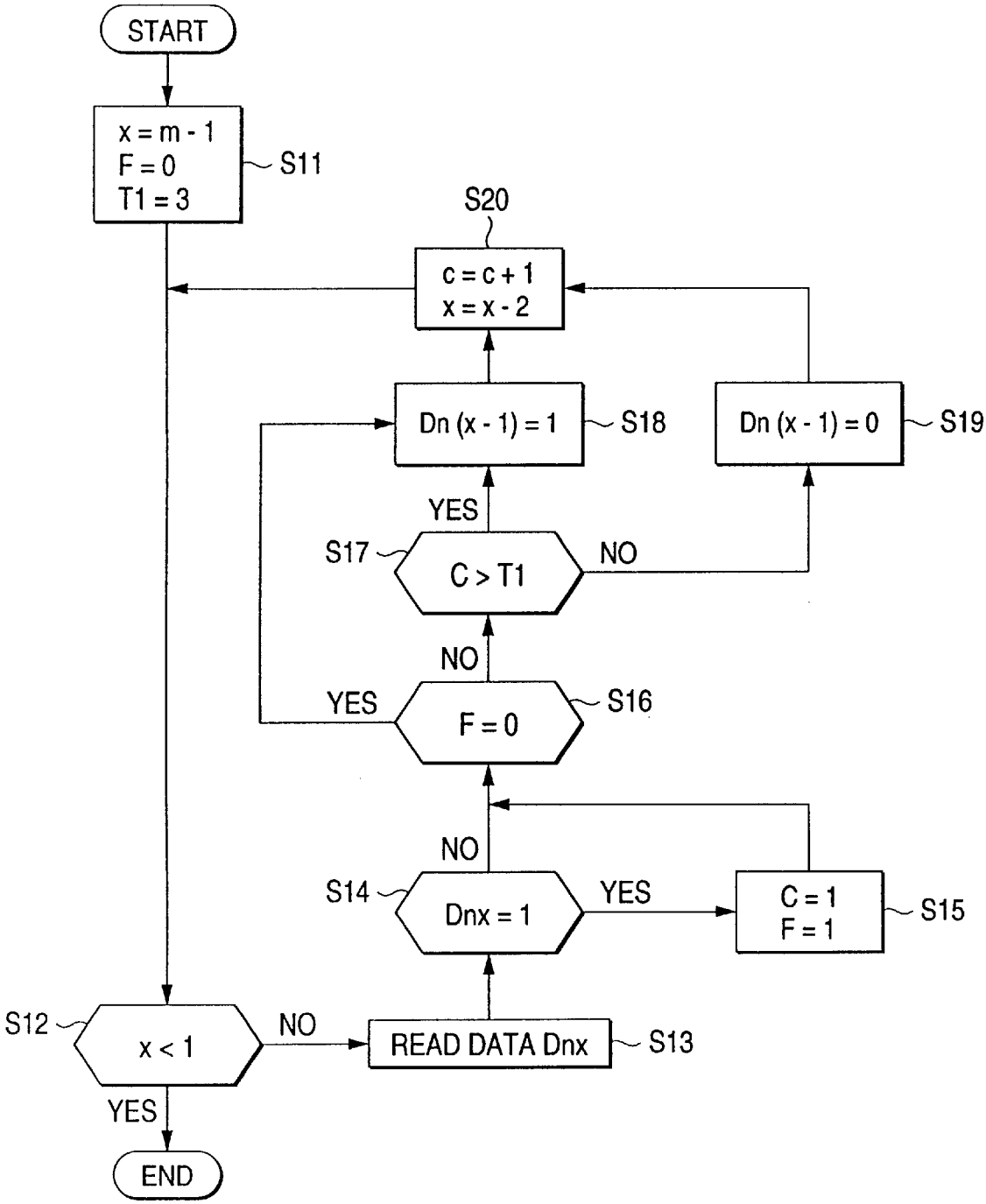
FIG. 7 is a flow chart showing a vibration data setting step according to a first embodiment of the present invention.

FIG. 7 is a flow chart specifically showing the vibration data setting process in the step S3 in FIG. 6.

In the description to follow, a print buffer of one line is denoted as Dnx (x: 1, 2, 3, . . ., m; m is an even number). The memory locations of the print buffer, which are designated by x of odd numbers, store ejection data for ejecting ink drops, and the memory locations, which are designated by x of even numbers, store vibration data. Data of "1", which is stored in the print buffer Dnx, permits the ink drop ejection or the fine meniscus vibration. (Dnx also represents the print data stored in the print buffer for ease of explanation.) Data Dnx of "0" inhibits the ink drop ejection or the fine meniscus vibration. Turning to FIG. 8, there is schematically shown print buffers for three nozzles #1 to #3. Data numbered 1 to 34 are stored in each print buffer. Ejection data is stored in the memory locations odd numbered 1, 3, 5, . . . , 33, and vibration data is stored in the memory locations even numbered 2, 4, 6, . . . 34. In FIG. 8, a black dot indicates that the data is "1", and a white dot indicates that the data is "0". As seen, the ejection data of x=3 in the print buffer #1 is "1". The vibration data of x=34 is "0".

Returning to FIG. 7, the controller sets a data read position x to x=(m−1), sets a flag F of "1" of the ejection data to 0, and sets a period T1 for inhibiting a fine vibration to 3 (S11). Then, the controller judges whether or not the data read position x is smaller than 1, viz., the ejection data to be read out is not left (S12). It is noted here that the final data of the print buffer is first processed in the vibration data setting process. In other words, the ejection data are successively analyzed in the reverse order from the final data to the first data, for the purpose of setting the vibration data.

The controller reads out data Dnx from the print buffer (S13), and judges whether or not the data Dnx is "1" (S14). If Dnx="1", the controller sets the flag F to "1", and initializes a counter C to "1" (S15), and advances to a step S16. When the data Dnx="0", the controller skips the step S15 to the step S16.

In the step S16, the controller judges whether or not the flag F is "0". If F="0", the controller goes to a step S18 to be described later. If F="1", the controller goes to a step S17. In this step, the controller checks if a value of the counter C exceeds the period T1 (=3). "0" is set to the data preceding to the data Dnx under check, or the vibration data Dn(x−1), till the value of the counter C reaches 4, which is larger than the period T1. When the value of the counter C exceeds the period T1,"1" is set to the vibration data Dn(x−1) (S18). When "1" or "0" is set to the vibration data (S18 or S19), the controller increments the contents of the counter C by "1" and decreases the data read position x by "2", in preparation for the reading of the next ejection data (S20).

In the flow chart shown in FIG. 7, the ejection data are successively analyzed from the last ejection data to the first ejection data. When "1" is set to the ejection data, the vibration data is set to "0" so as to inhibit the fine vibration during three printing periods preceding to the ejection printing period (S14: YES, S15, S16: NO, S17: NO, S20). When "0" is set to the ejection data, "1" is set to the vibration data located preceding to the ejection data (S14: NO, S16: YES, S18, S20).

Figure 8:
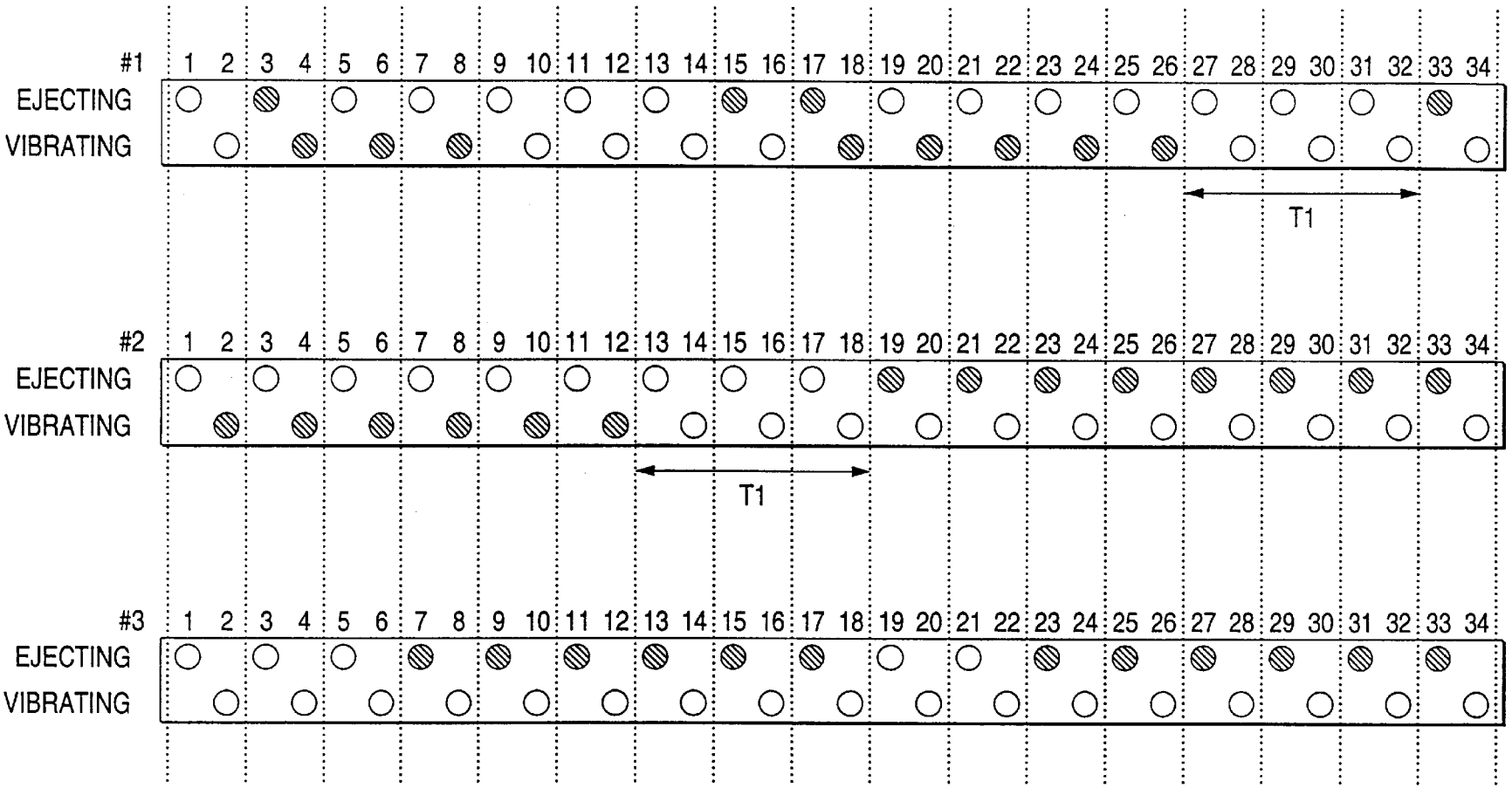
FIG. 8 is an explanatory diagram showing how the vibration data is set for fine meniscus vibration in the vibration data setting step of FIG. 7.

FIG. 8 is an explanatory diagram showing how the vibration data is set for fine meniscus vibration. As shown, 17 number of printing periods are illustrated. "1" is stored in the final ejection data Dn33 of the nozzle #1. Accordingly, "0"s are set to the vibration data Dn32, Dn30 and Dn28 during three consecutive printing periods preceding to the ejection data Dn33. "1"s are set to the vibration data Dn26, Dn24, Dn22, Dn20, and Dn18 till the ejection data Dn17 of "1" is checked.

"1"s are set to two consecutive ejection data Dn17 and Dn15, respectively. If "1" is set to the ejection data Dn17 and "0" is set to the election data Dn15, "1" is set to the vibration data Dn10 located at the fourth printing counted up from the ejection data Dn17. In this instance of the embodiment, however, "1" is set to the ejection data Dn15, and hence the fine vibration is inhibited in the data Dn16, Dn14, Dn12 and Dn10.

In the case of the nozzle #2, "1"s are set to the ejection data Dn19 and the subsequent ones, and "1"s are set to the vibration data Dn12 located at the fourth printing period counted up from the ejection data Dn19, and the vibration data preceding to the data Dn12. Therefore, the nozzle #2 is finely vibrated during the printing periods before the dot formation, and the fine meniscus vibration is inhibited during the three printing periods preceding to the printing period. In the case of the nozzle #3, the vibration inhibiting periods defined by T1 overlap with each other, so that no fine meniscus vibration is performed in this nozzle.

The present embodiment described above produces the following useful effects.

Firstly, the dot pattern data applied to the recording head 20 is generated by analyzing the print data and previously sets the vibration data at predetermined positions. Therefore, a necessary magnitude of fine vibration may be applied to the meniscus of each nozzle at a necessary position. In other words, dot forming states of all the dots in one print line, not one specific dot, are taken into account for the application of the fine vibration to the meniscus of each nozzle. This technical fact accrues to the following merits: to prevent an increase of a viscosity of ink in the nozzle, to stabilize a flying path of the ink drop, and to keep the print quality high. A further merit is that a flushing interval can be extended. This is due to the fact that an increasing rate of the ink viscosity is retarded since an appropriate fine vibration is applied to the meniscus. The extension of the flushing interval reduces an amount of ink wasted as the result of the flushing operation, and a running cost of the printer.

Secondly, a good flying performance of an ink drop is secured. The reason for this follows. The meniscus in each nozzle is not vibrated for three consecutive printing periods preceding to a printing period in which an ink drop is ejected. Therefore, the meniscus is sufficiently stabilized before the ejection of the ink drop is conducted. Some time is taken till the vibrating meniscus settles down through damping of the vibration, although the time length depends on a magnitude of the vibration. If an ink drop is ejected before the vibrating meniscus settles down, the weight, shape, and flying path of the ink drop vary, to possibly loose the fixing of a landing position of the ink drop, and the diameter of a dot formed by the ink drop are unstable. It is noted again that the meniscus in each nozzle is not vibrated for three consecutive printing periods preceding to an ink ejection printing period, and hence the vibrating meniscus sufficiently settles down before the ejection of the ink drop starts.

Thirdly, use of the present invention does not adversely affect the printing speed since the fine vibration of the meniscus is performed during the printing operation. This fact leads to reduction of printing time.

A second embodiment of the present invention will be described with reference to FIGS. 9 and 10. In these figures, like or equivalent portions are designated by like reference numerals used for explaining the first embodiment. A feature of the second embodiment resides in that the vibration data (vibration bit data) of one print line (one main scanning line) is patterned into a second pattern. The second pattern controls the application of fine vibration to the meniscus of ink such that no fine vibration is applied to the ink meniscus (viz., the meniscus of ink is not finely vibrated) during a first printing period preceding to the ink ejection, but fine vibration is applied to the meniscus (viz., the meniscus is finely vibrated) during a second period preceding to the first period.

Figure 9:
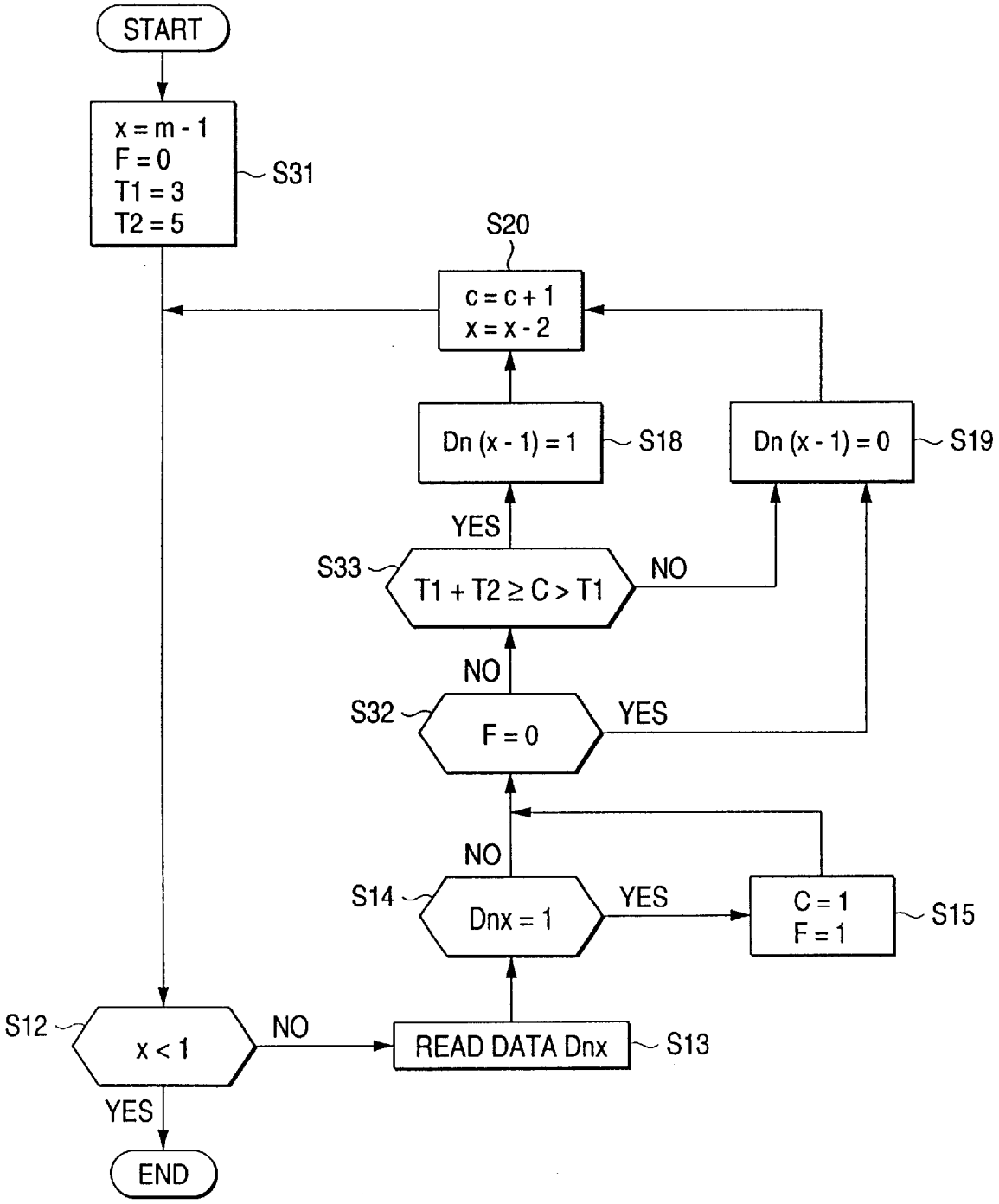
FIG. 9 is a flow chart showing a vibration data setting step according to a second embodiment of the present invention.

FIG. 9 is a flow chart showing a vibration data setting process according to the present embodiment. In this vibration data setting process, steps S12 to S15 and S18 to S20, except steps S31 to S33, are the same as the corresponding ones in the FIG. 7 process.

The initializing step S31, executed by the control section 6, sets the data read position x to "m−1", and resets the ejection flag F to "0". Further, it sets "3" to a first period T1, and "5" to a second period T2. As seen from FIG. 10, the first period T1 is a parameter to define a period to inhibit the fine vibration. The first period T1 consists of three printing periods located preceding to the ink ejection, i.e., a printing period where an ink drop is ejected. "0" is set to the vibration data of the vibration inhibiting period. The second period T2 is a parameter to define a period to permit the fine vibration. The second period T2 consists of five printing periods located preceding to the first period T1. "1" is set to the vibration data of those printing periods. Namely, in this embodiment, a vibrating pattern is set such that the application of fine vibration is permitted for five printing periods and then inhibited for three printing period precede to the ink ejection (hereinafter, referred to as a second vibrating pattern).

Following the initializing step (S31), the steps S12 to S14 are executed, and the step S32 is executed. This step S32 checks as to if F (the ejection flag)="0". If F="0", the step S19 is then executed. This step sets "0" to the vibration data Dn(x−1), located preceding to the ejection data Dnx. Thus, the second pattern inhibits "1" from being set to the fine vibration till the ejection data of "1" is detected.

If F="1", the answer to the step S32 is NO, and then the step S33 is executed. The step S33 judges if the value of the counter C satisfies (T1+T2≧C>T1). The answer to the step S33 remains NO till the value of the counter C reaches "4". The step S19 sets "0" to the vibration data. When the value of the counter C is within a range from "4" to "8", the answer to the step S33 is YES, and the step S18 sets "1" to the vibration data. When the value of the counter C exceeds "9", the answer to the step S33 is NO, and the step S19 sets "0" to the vibration data.

Figure 10:
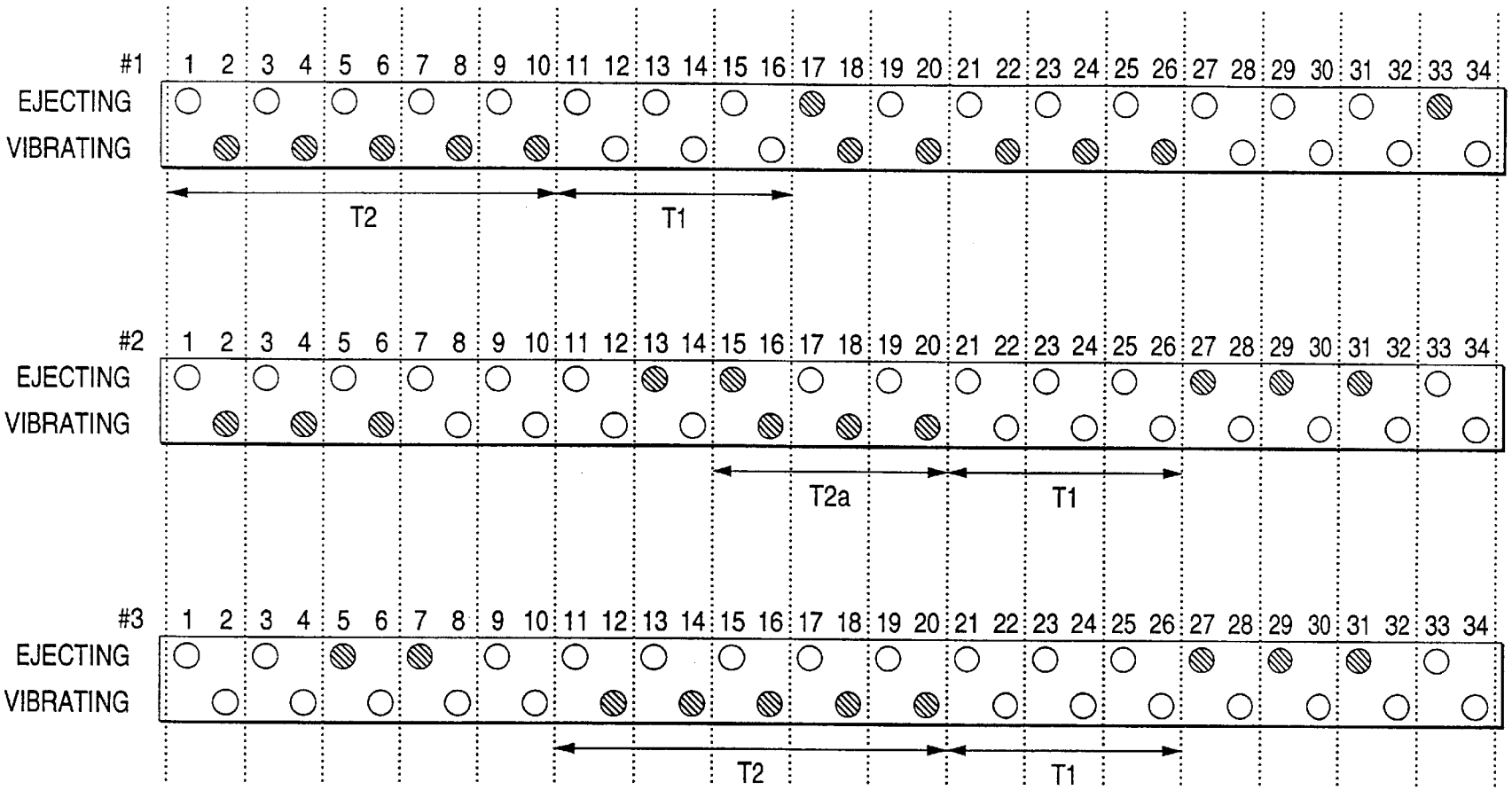
FIG. 10 is an explanatory diagram showing how the vibration data is set in the vibration data setting step of FIG. 9.

FIG. 10 is an explanatory diagram showing how the vibration data is set for fine meniscus vibration in the vibration data setting process of FIG. 9. Let us consider the nozzle #1. As seen, "1" is set to the ejection data Dn17. "0"s are set to the vibration data Dn16, Dn14 and Dn12 during a first period T1 consisting of three printing periods, which precedes the ejection data Dn17. "1"s are set to the vibration data Dn10, Dn8, Dn6, Dn4 and Dn2 during a second period T2 consisting of five printing periods, which precedes to the first period T1. In the nozzle #2, "1" is set to the ejection data Dn27. "0"s are set to three vibration data Dn26, Dn24 and Dn22, which are contained in the first period T1, and "1"s are set to three vibration data Dn20, Dn18 and Dn16, which are contained in a second period T2*a*. In this instance, the second period T2*a* consists of three printing periods, not five printing periods. This is because "1" is set to the ejection data Dn15, and the first period T1 precedes to the ejection data Dn15. In the nozzle #3, the fine vibration is performed only during five consecutive printing periods, which are within the second period T2, and no fine vibration is performed during other printing periods (Dn10, Dn8, Dn6, Dn4 and Dn2 are "0") than those of the second period T2. In this respect, the second embodiment is different from the first embodiment.

The second embodiment thus constructed produces useful effects similar to those of the first embodiment. In the second embodiment, the fine vibration is performed during the second period T2 preceding to the first period T1. Therefore, there is no chance of applying an excessive vibration to the meniscus of each nozzle. Accordingly, the second embodiment efficiently vibrates the meniscus of each nozzle to prevent the ink viscosity increase, and reduces an electric power consumed.

A third embodiment of the present invention will be described with reference to FIGS. 11 and 12. A feature of the third embodiment resides in that the vibrating pattern of the second embodiment is applied to also an accelerating region ranging from a stand-by position of the recording head 20 to a start position in a print region.

Figure 11:
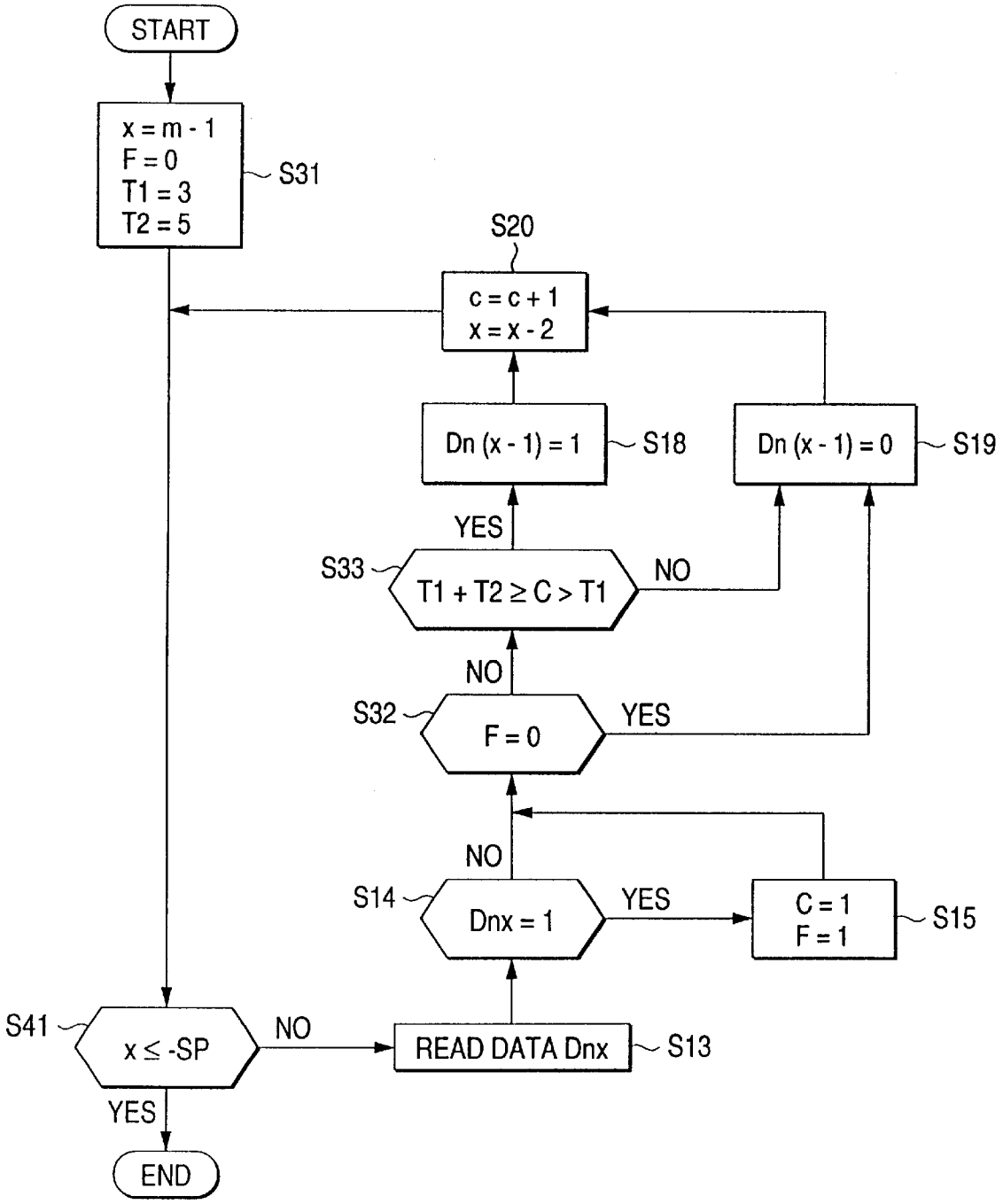
FIG. 11 is a flow chart showing a vibration data setting step according to a third embodiment of the present invention.
Figure 12:
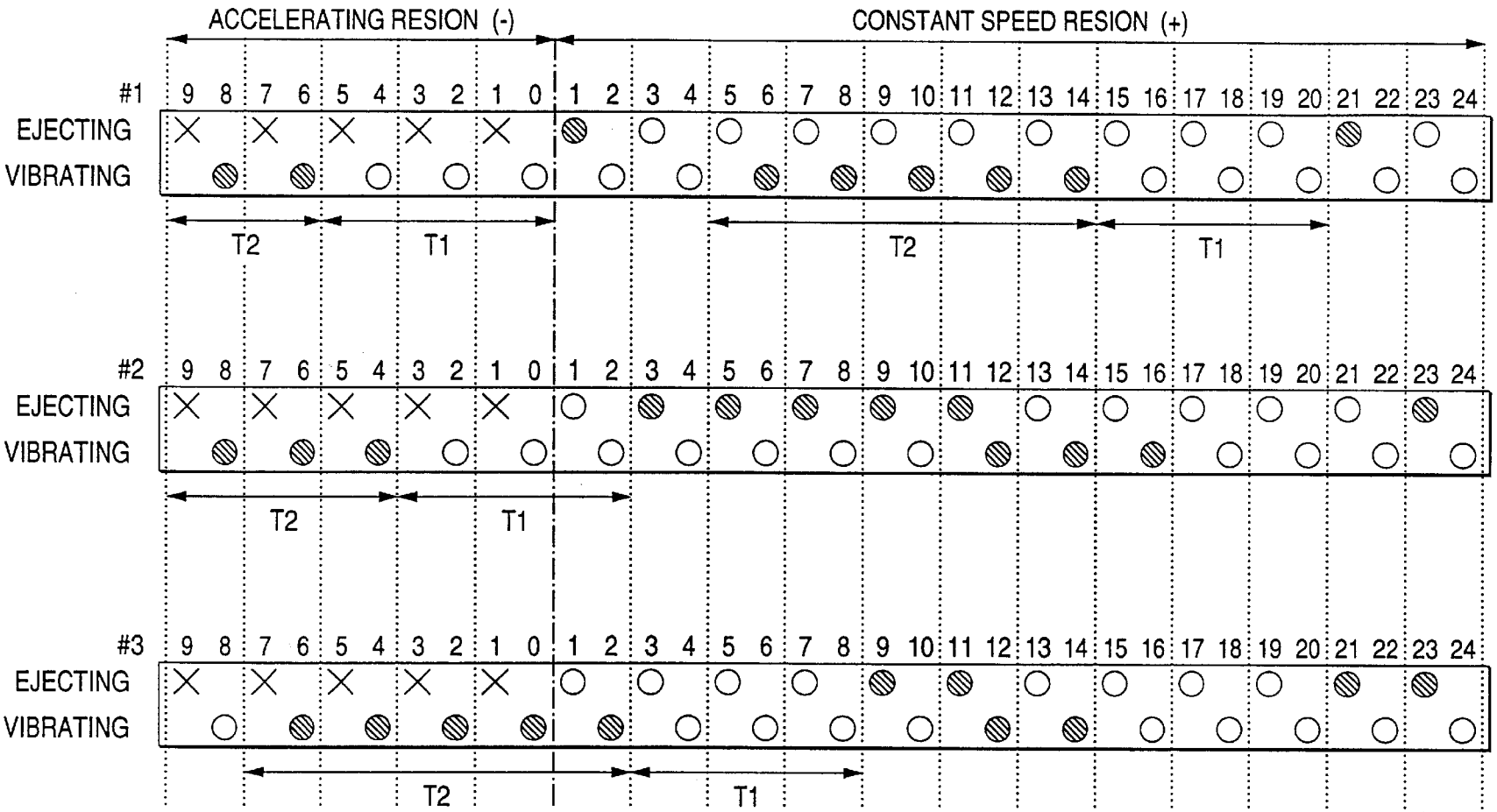
FIG. 12 is an explanatory diagram showing how the vibration data is set in the vibration data setting step of FIG. 11.

FIG. 11 is a flow chart showing a vibration data setting process according to a third embodiment of the present invention. The vibration data setting process includes all the steps shown in FIG. 9 except the step S12. The third embodiment uses a step S41 in place of the step S12. In this embodiment, the print buffer is extended to cover the accelerating region where the carriage is accelerated. If a position of data indicative of a start position of the print region is set at 1, the print buffer is extended so as to store data of values up to a set reference value of about−100. Accordingly, in the step S41, the controller reads out the print data Dnx from the print buffer till the carriage reaches the position of the set reference value SP, which is set in the accelerating region and located before the start point of the print region. FIG. 12 is an explanatory diagram showing how the vibration data is set for fine vibration by the vibration data setting process of FIG. 11. As seen, the print buffer is extended to cover the accelerating region, located beyond the start position of the print region. In the accelerating region, no printing operation is performed, and hence the ejection data in the accelerating region is marked with "X". A minus sign "−" is assigned to the data read positions 1 to 9 in the accelerating region.

In the nozzle #1, a print dot is formed at the start position (x=1) of the print region (Dn1=1). Accordingly, the first period T1 (vibration inhibiting period) and the second period T2 (vibration permitting period) are both located in the accelerating region of the carriage. In this case, an appropriate fine vibration is applied to the nozzle #1 before the recording head 20 reaches the print start position. As in the case of the nozzle #2, a part or the entire of the first period T1 may belong to a constant speed region (print region) depending if a position at which the first dot is formed is so located. As in the case of the nozzle #3, a part of the second period T2 may belong to the constant speed region. In either case, no fine vibration is performed during three consecutive printing periods preceding to the ink ejection period, and the fine vibration is performed during five consecutive printing periods preceding to those vibration-inhibiting printing periods, as in the second embodiment.

Also in the third embodiment, the fine vibration of the meniscus of each nozzle is inhibited during the period preceding to the ink ejection, while the fine vibration is permitted during the second period T2. Therefore, increase of the ink viscosity is greatly suppressed and an ink drop may be ejected after the vibrating meniscus settles down, as in the second embodiment. Further, in the third embodiment, a proper fine vibration may be applied to the meniscus of ink of each nozzle before the recording head 20 reaches the start position of the print region. Thus, the third embodiment prevents the ink viscosity from increasing and stabilizes a flying path of the ink drop even if the print dot is formed at the start position of the print region.

A fourth embodiment of the present invention will be described with reference to FIGS. 13 and 14. A feature of the fourth embodiment resides in that the fine vibration is applied to the meniscus of ink after a predetermined time elapses from the ejection of an ink drop (hereinafter, referred to as a third vibrating pattern).

Figure 13:
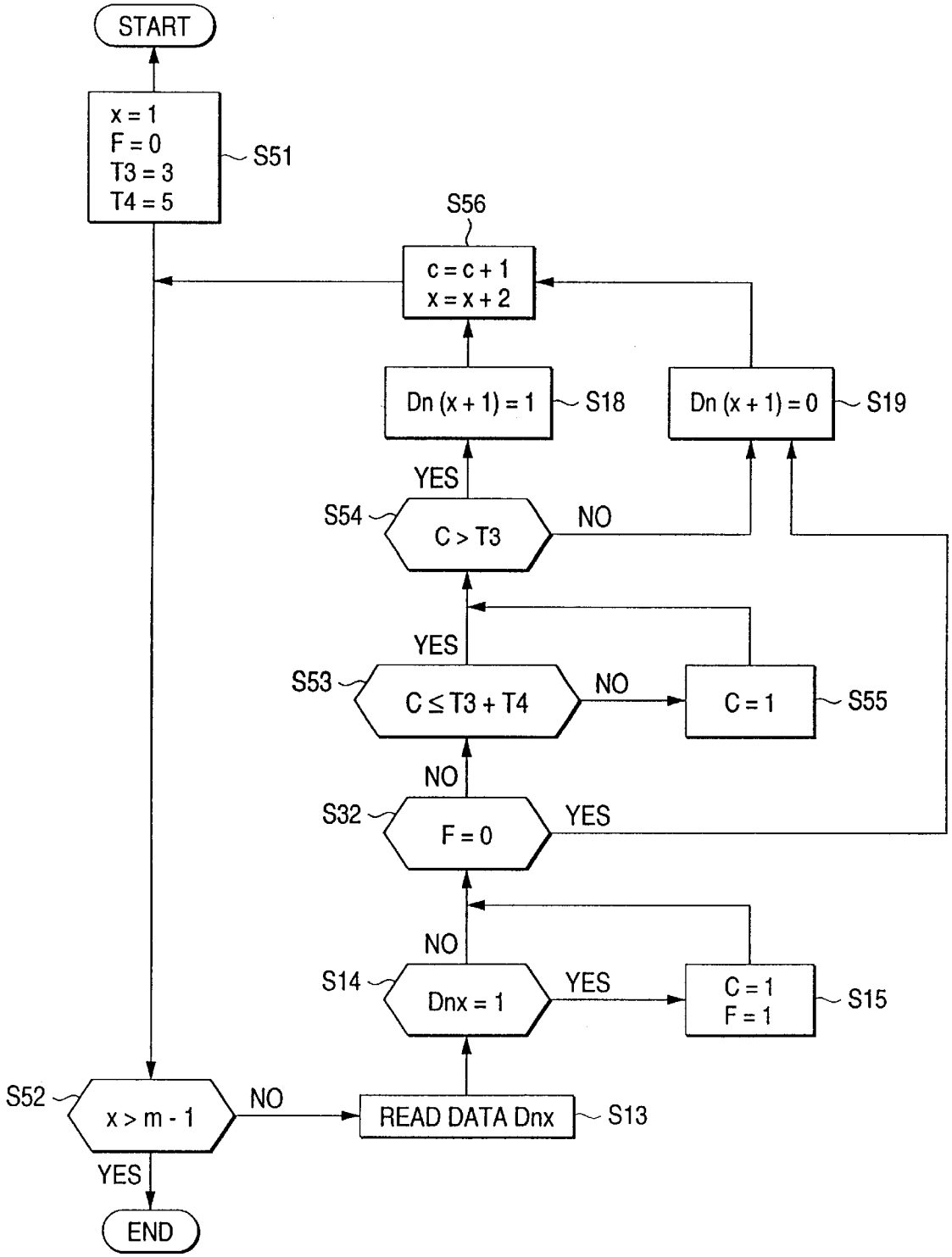
FIG. 13 is a flow chart showing a vibration data setting step according to a fourth embodiment of the present invention.

FIG. 13 is a flow chart specifically showing a vibration data setting process, which forms a fourth embodiment of the present invention. The vibration data setting process of this embodiment reads the ejection data from the print buffer in the order from the first ejection data to the last ejection data, while each vibration data setting process already mentioned reads the ejection data from the print buffer in the reverse order from the last ejection data to the first ejection data. Accordingly, in an initializing step S51, the controller sets the data read position x to "1", and sets the ejection flag F to "0", sets a first period T3 to "3", and sets a second period T4 to "5". In a step S52, the controller checks if the data read position x exceeds "m−1", viz., the last ejection data has been read out from the print buffer. Thus, the first ejection data is first read out from the print buffer, the second ejection data is then read out, and the last ejection data is finally read out.

When the read out ejection data Dnx="0", the answer to the step S32 is YES, and the control advances to the step S19 where "0" is set to the vibration data. Then, the controller increments the value of the counter C by 1, and increments the data read position x by 2, and prepares for reading out the next ejection data from the print buffer (S56).

When Dnx="1", the controller resets the counter C to 1, and sets the ejection flag F to "1" (S15). The step S32 is then executed to present the answer of NO, and then a step S53 is executed to check if the value of the counter C is smaller than the sum of the first and second periods T3 and T4. If it is smaller than the sum (T1+T2), a step S54 is executed to check if the value of the counter C is larger than the first period T3. If it is smaller than the first period T3 (the answer is NO), the step S19 is executed to set "0" to the vibration data during the first period T3 preceding to the ink ejection period, and accordingly, no fine vibration is performed.

When the value of the counter C exceeds the value of the first period T3 (C>T3), the answer to the step S54 is NO and the controller advances to the step S18. In this step, the vibration data is set to "1" immediately after the first period T3 terminates. The answer to the steps S53 and S54 remains YES till the value of the counter C exceeds the sum (T3+T4), and the vibration data is set to "1". When C>(T3+T4), the answer to the step S54 is NO, and the counter C is reset to 1 (S55).

Figure 14:
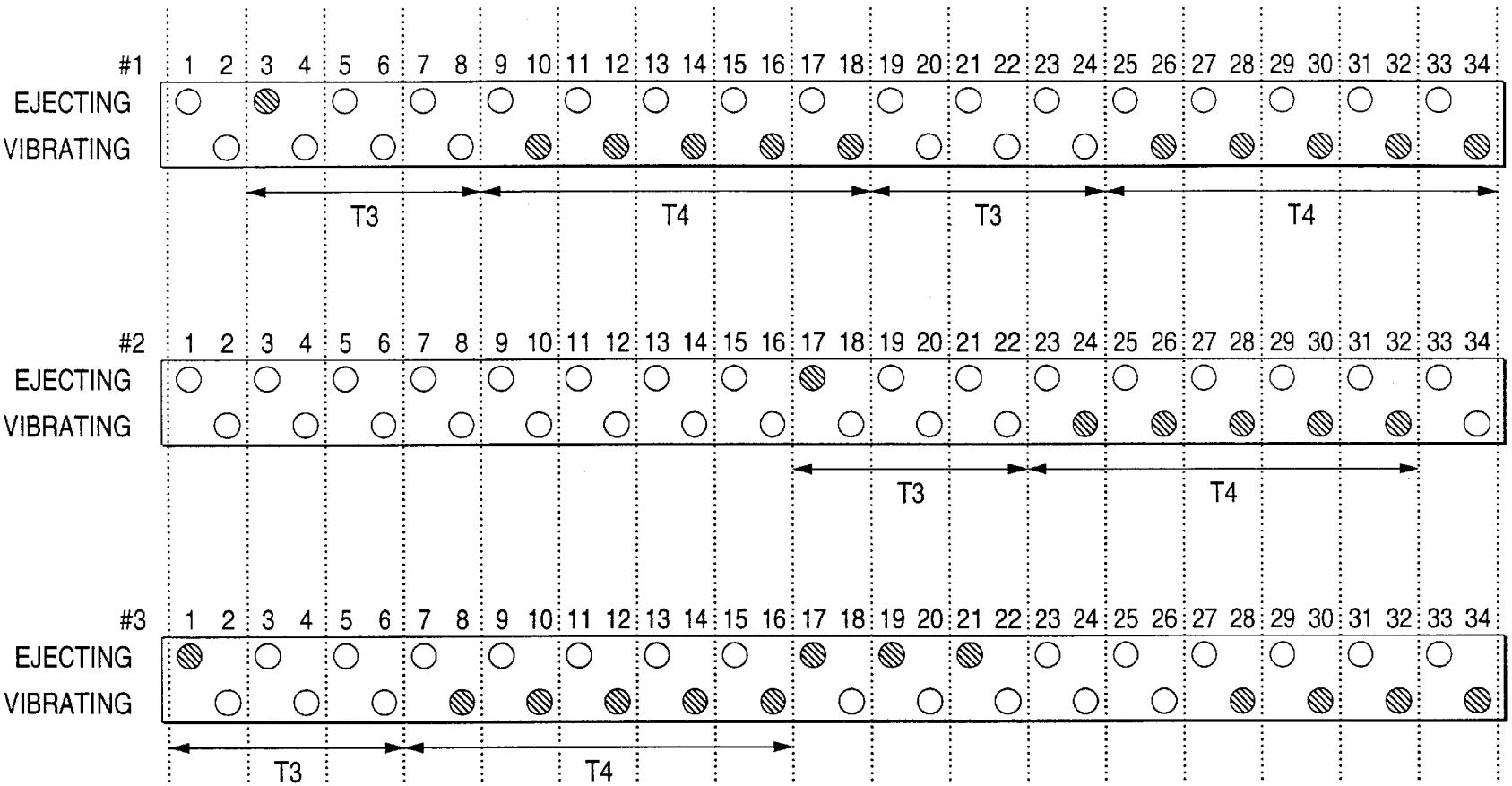
FIG. 14 is an explanatory diagram showing how the vibration data is set in the vibration data setting step of FIG. 13.

As seen from FIG. 14, when the nozzle rests for the first period T3 or longer, the vibration data setting process under discussion applies fine vibration to the meniscus of ink for a second period T4, to thereby prevent the ink viscosity increase. As shown, in the nozzle #1, an ink drop is ejected at Dn3 (ejection data of "1"); a first period T3 (three printing periods) follows Dn3; and a second period T4 (five printing periods) where the vibration data are "1"s follows the first period T3. Subsequently, this vibrating pattern is periodically repeated in which a bit of "1" (valid ejection data), three bits of "0"s (invalid vibration data, first period T3), and four bits of "1"s (valid vibration data, second period T4) are serially arrayed. In the nozzle #2, the vibration data is not set to "1" (remains invalid) till a valid ejection data (of "1") is detected.

The fourth embodiment has useful effects comparable with those of the first embodiment. Further, in the vibration data setting process of the fourth embodiment, after the nozzle ejects an ink drop, the nozzle rests for a predetermined time period (first period T3), and then the vibration data is made valid for the second period T4. Therefore, an appropriate fine vibration is applied to the meniscus of the ink in each nozzle while considerably suppressing undesired fine vibration, whereby the ink viscosity increase is prevented. Immediately after the ink ejection, the ink near the nozzle orifice is refreshed. Because of this, there is no need of applying a fine vibration to the meniscus of the ink. In this respect, it is noted that the vibrating pattern of the vibration data set by the fourth embodiment eliminates excess fine vibration of the meniscus immediately after the ink ejection. This vibrating pattern applies a necessary amount of fine vibration to the meniscus of ink at such time that the firs,t period T3 elapses and the ink solvent evaporation may start.

A fifth embodiment of the present invention will be described with reference to FIGS. 15 and 16. The fifth embodiment provides a vibration data setting process capable of periodically applying a fine vibration to the resting nozzle or nozzles (hereinafter, referred to as a fourth vibrating pattern).

Figure 15:
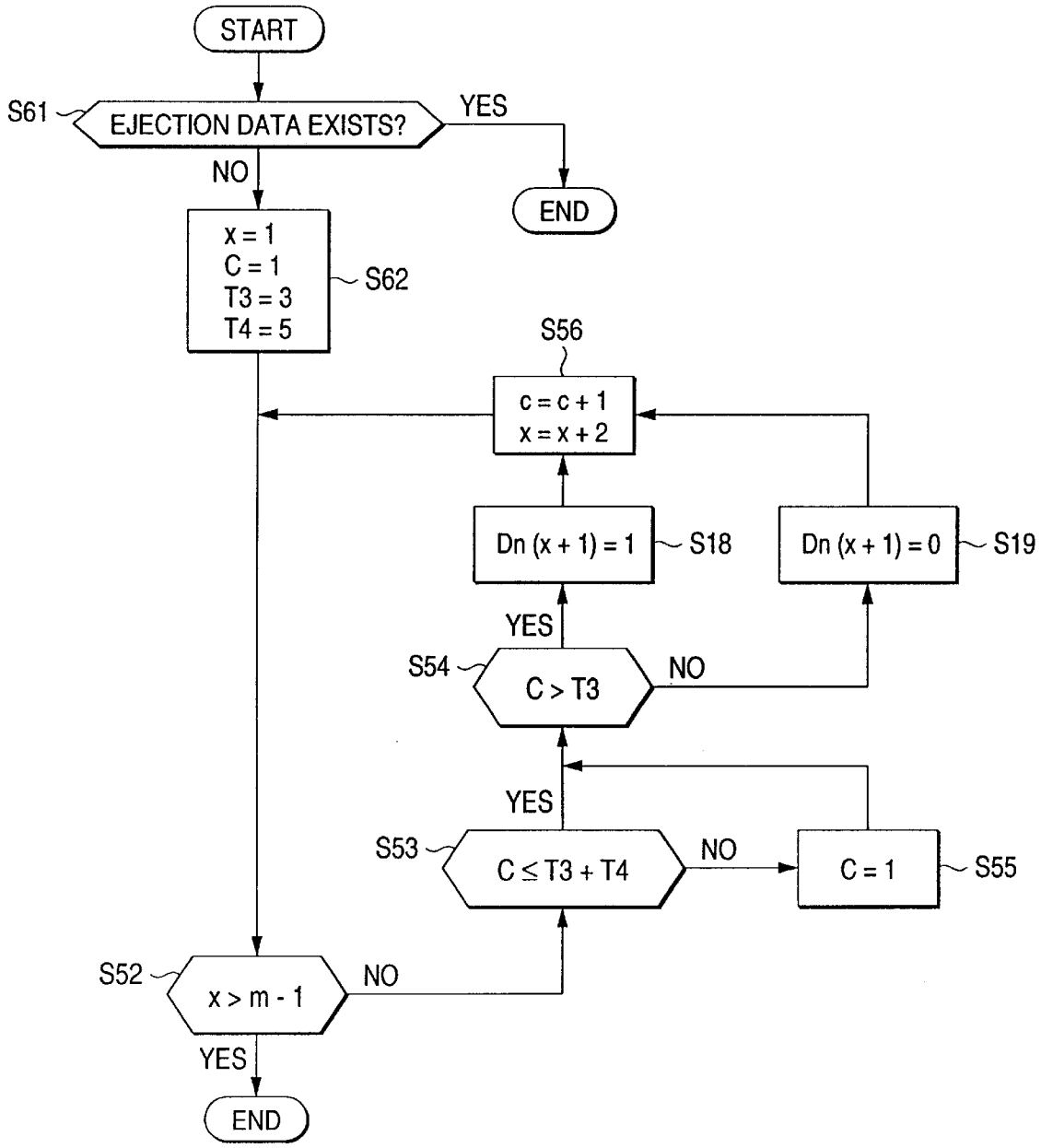
FIG. 15 is a flow chart showing a vibration data setting step according to a fifth embodiment of the present invention.

FIG. 15 is a flow chart specifically showing a vibration data setting process according to the fifth embodiment of the present invention. In the flow chart, in a step S61, the controller checks if the ejection data of "1" (valid ejection data) is contained in one print line. If the answer to the step S61 is YES, the controller judges that there is no nozzle being in a state of rest, and ends the vibration data setting process.

If the answer to the step S61 is NO, the controller judges that the print line includes the nozzle being resting, and advances to a step S62 and initializes the related parameters; x (data read position)=1, C (counter value)=1, T3 (first period)=3, and T4 (second period)=5. The controller starts the processing of the ejection data in the order from the first ejection data to the last ejection data (S52), and repeats periodically a sequence of operations, non-application of fine vibration for a first period T3 and application of fine vibration for a second period T4.

Figure 16:
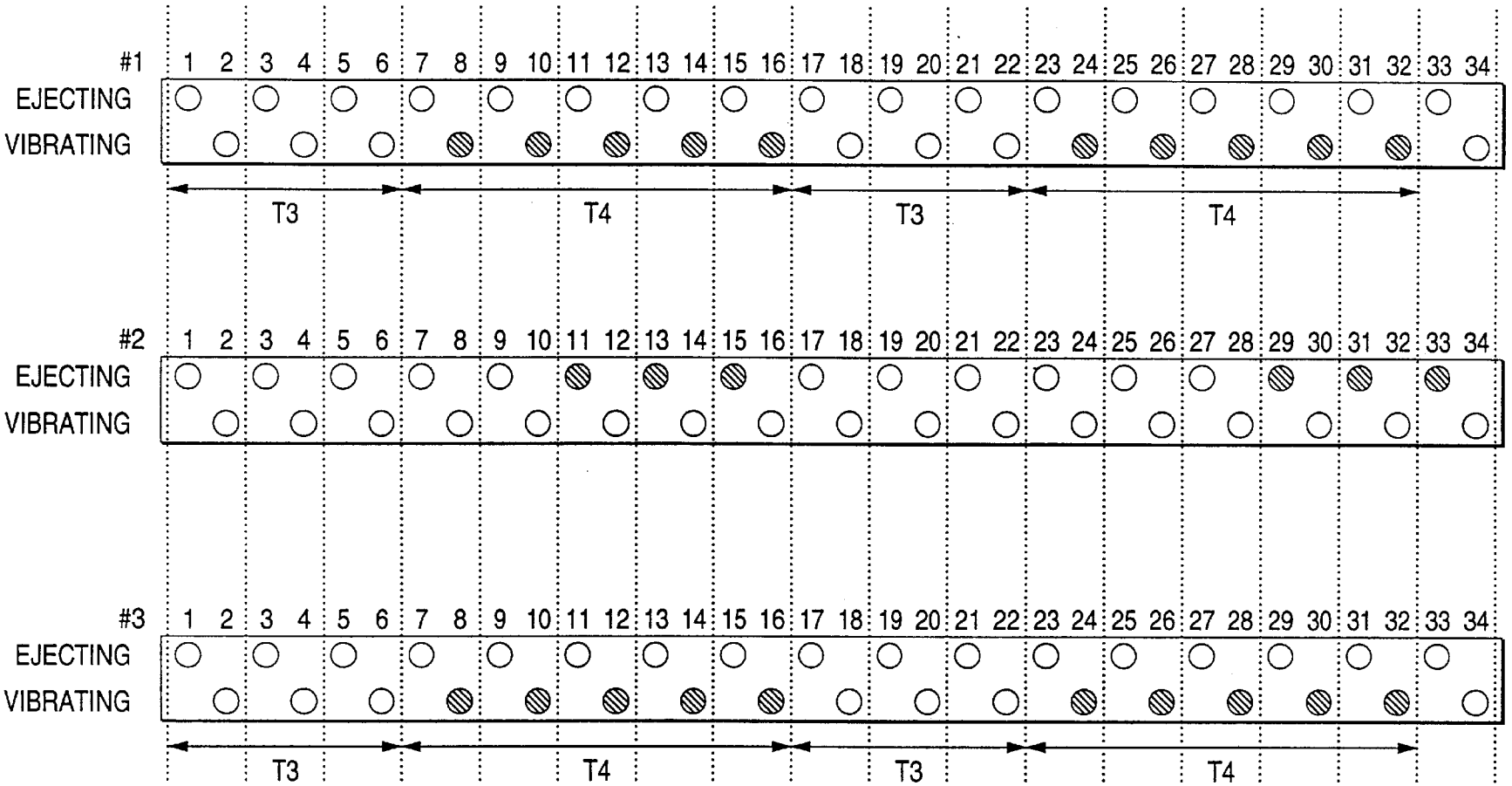
FIG. 16 is an explanatory diagram showing how the vibration data is set in the vibration data setting step of FIG. 15.

As seen from FIG. 16, in the case of the nozzles #1 and #3, each print line includes no valid ejection data, i.e., the ejection data of "1" causing the nozzle to eject an ink drop. Therefore, the meniscus of the ink in the nozzle is periodically subjected to a fine vibration for the second period T4, whereby preventing of ink viscosity increase is ensured.

A sixth embodiment of the present invention will be described with reference to FIGS. 17 to 20. A feature of the sixth embodiment resides in that a vibrating period and a ratio of an actual vibration period to the vibrating period (referred to as a vibrating ratio) may be varied depending on ambient temperature).

Figure 17:
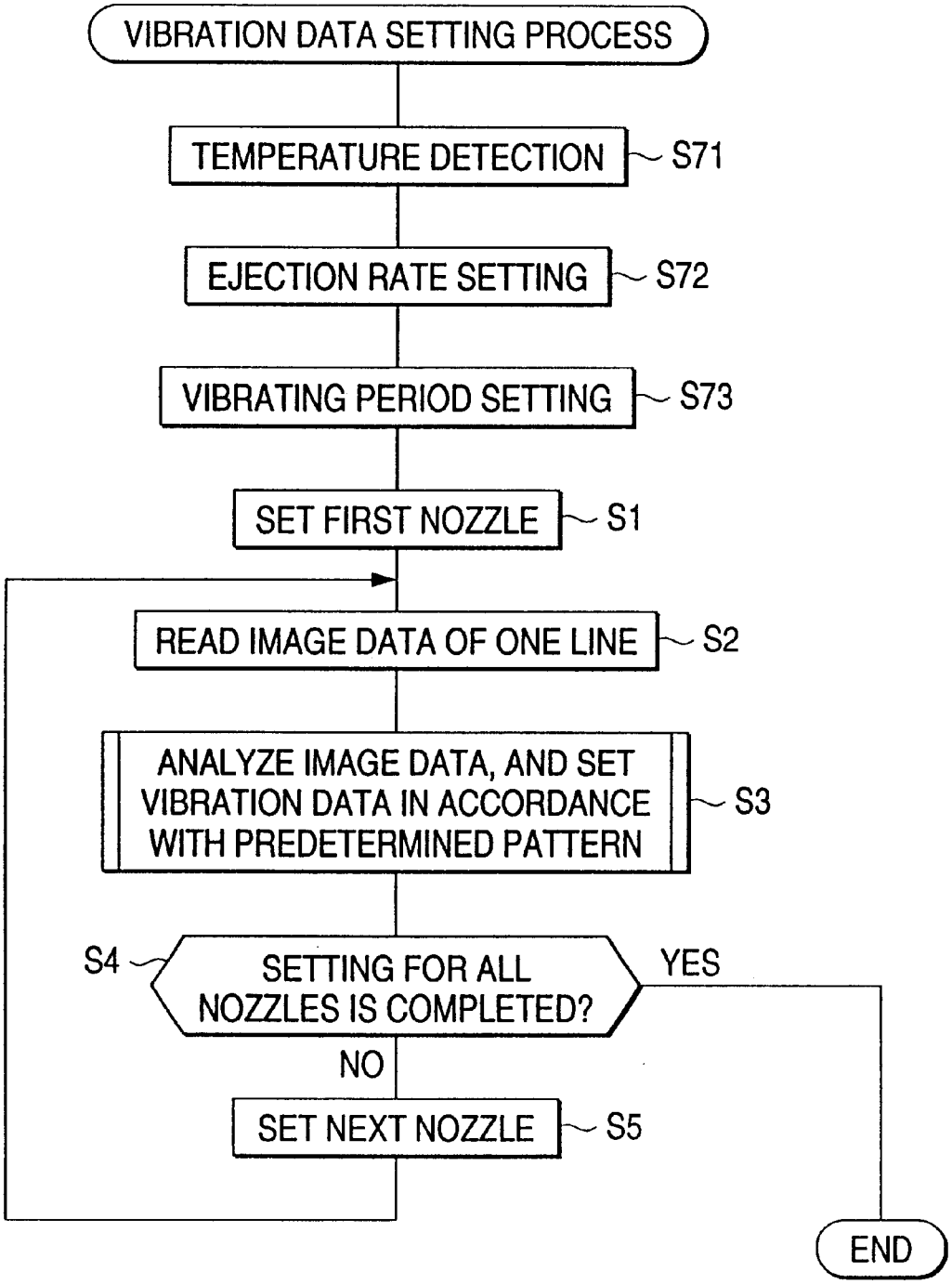
FIG. 17 is a flow chart showing a vibration data setting step according to a sixth embodiment of the present invention.

FIG. 17 is a flow chart showing a vibration data setting process according to the sixth embodiment of the present invention. As shown, the vibration data setting process includes all the steps, S1 to S5, of the flow chart of FIG. 6. The process of the step S3, which is a vibration data setting process to form a specific vibrating pattern, may be any of the corresponding processes of the first to fifth embodiments. In the FIG. 17 flow chart, an ambient temperature is detected by means of a temperature sensor attached to the recording head 20 or a main control board (S71). Then, the controller determines a vibrating ratio (S72) and a vibrating period (S73) depending on the detected ambient temperature, while referring to period and ratio maps to be described later.

Figure 18:
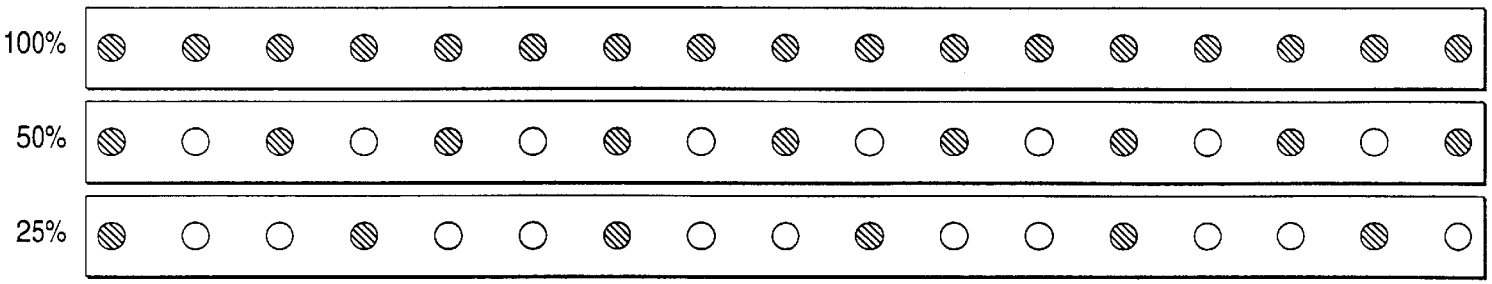
FIGS. 18(*a*) to (*c*) are diagrams for explaining a vibrating period and a vibrating ratio in connection with ambient temperature.
Figure 18:
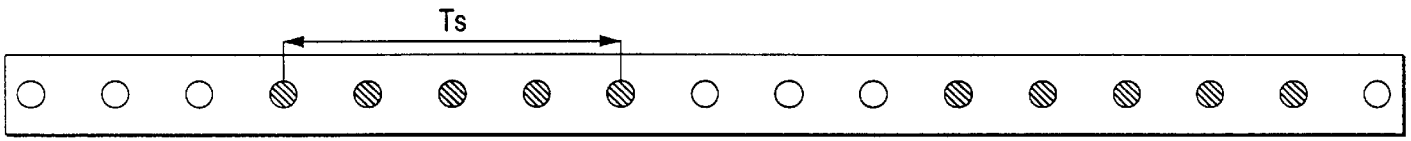
Figure 18:
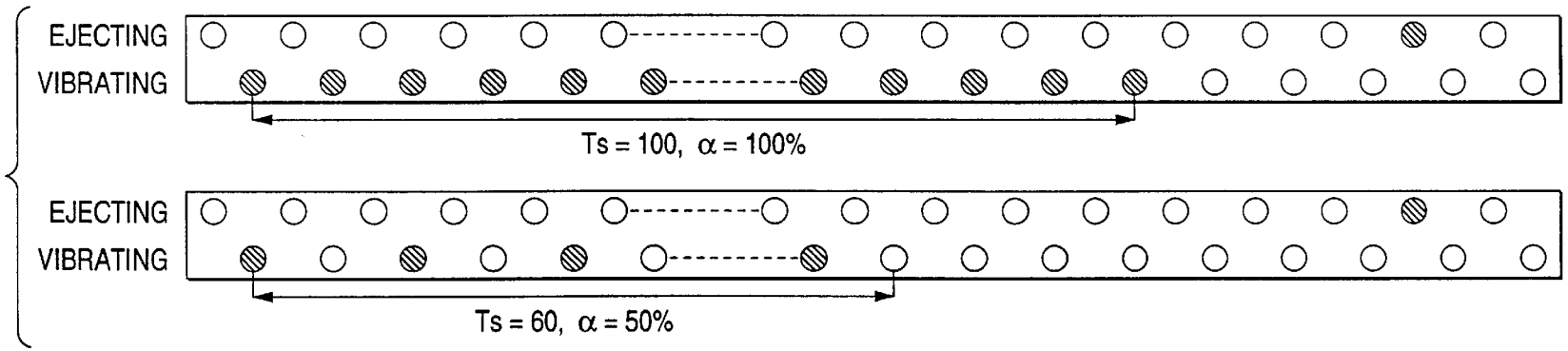

FIGS. 18 (*a*) to (*c*) show a relationship between the vibrating period and the vibrating ratio. Only vibration data are shown in FIGS. 18(*a*) and 18(*b*) for simplicity. As seen from FIG. 18(*a*), the vibrating ratio $\alpha$ is a ratio of an actual vibration period to a vibrating period Ts. When$\alpha$=100%, all the vibration data (=all bits) during the vibrating period Ts are set to "1"s. When $\alpha$=50%, those bits of the vibration data are set to "1"s every other bit.

The vibrating period Ts is a period where fine vibration is applied to the meniscus of ink, as shown in FIG. 18(*b*). When Ts=100 and $\alpha$=100%, the vibration data (bit data) are all set to "1"s during 100 number of consecutive printing periods, as shown in FIG. 18(*c*). When Ts=60 and $\alpha$=50%, the vibration data are alternately set to "1"s during 60 number of consecutive printing periods.

Figure 19:
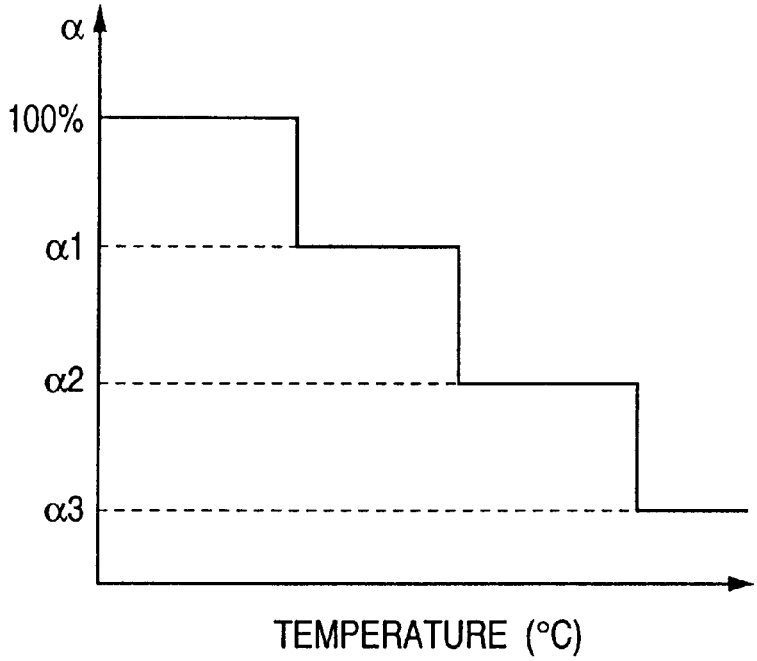
FIGS. 19(*a*) and (*b*) show a reference map for the vibrating ratio and a reference map for the vibrating period, respectively in connection with the ambient temperature.
Figure 19:
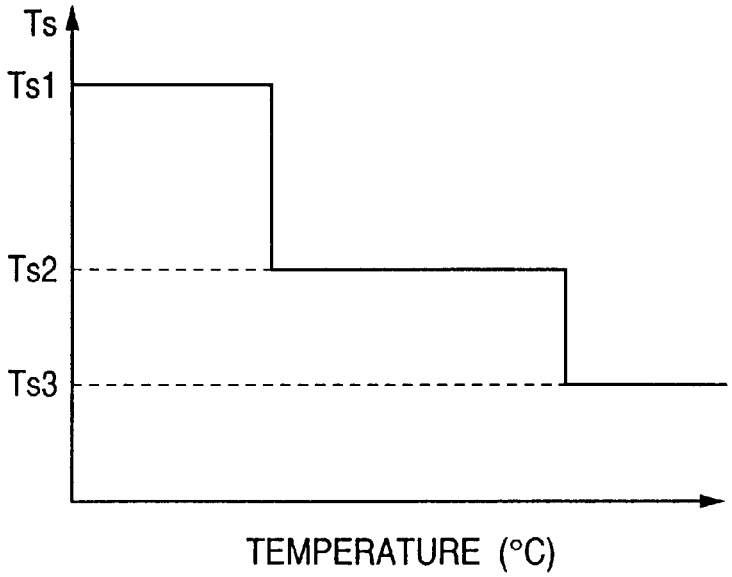

FIGS. 19(*a*) and (*b*) show the vibrating period map and a reference map for the vibrating ratio map, respectively. A fine-vibration-ratio map shown in FIG. 19(*a*) is depicted such that a vibrating ratio $\alpha$ is stepwise decreased with increase of ambient temperature. A fine-vibration-period map shown in FIG. 19(*b*) is depicted such that a vibrating period Ts is stepwise decreased with increase of ambient temperature. The variation of the vibrating ratio and the vibrating period is not limited to the stepwise variation, but may be linear or curved. In FIG. 19(*a*), $\alpha$1 represents a vibrating ratio at high temperature; $\alpha$2 represents a vibrating ratio at normal temperature; and $\alpha$3 represents a vibrating ratio at high temperature. In FIG. 19(*b*), Ts1 represents a vibrating period at high temperature; Ts2 represents a vibrating period at normal temperature; and Ts3 represents a vibrating period at high temperature. Those maps are given by way of examples. Hence, the maps may be depicted in other ways. For example, the vibrating ratio at low temperature may be set at 100%.

Figure 20:
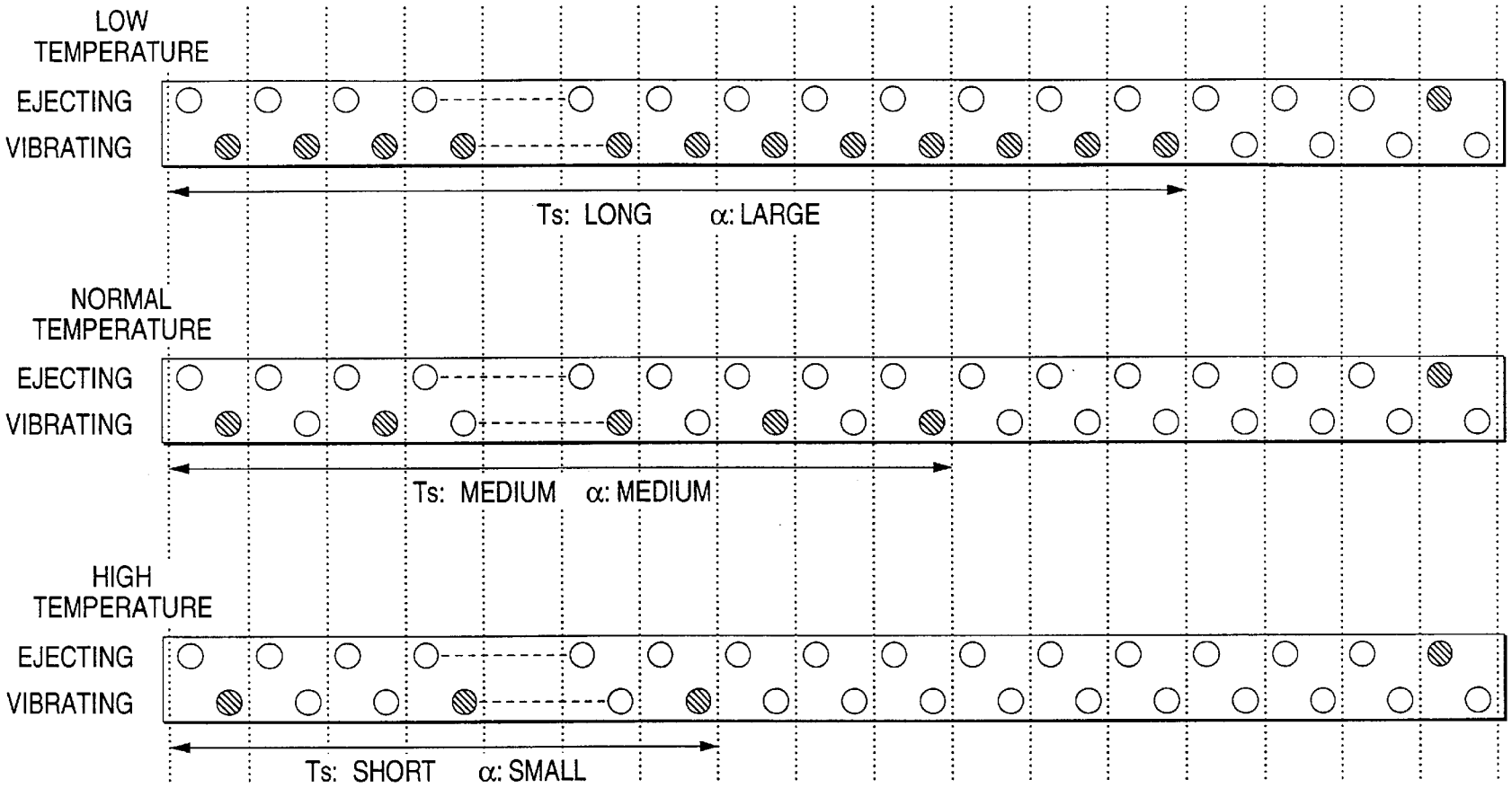
FIG. 20 is an explanatory diagram showing how the vibration data is set in the vibration data setting step of FIG. 17.

FIG. 20 is a diagram useful in explaining how the vibration data is set in connection with ambient temperature. As shown, at low temperature, the vibrating period Ts is set to be longer than at normal temperature, and the vibrating ratio a is also set to be larger than at normal temperature. Accordingly, in low temperature condition, the meniscus of ink is finely vibrated for a longer time, thereby suppressing an ink viscosity increase. At high temperature, the vibrating period Ts is set to be shorter than at normal temperature, and the vibrating ratio $\alpha$ is also set to be smaller than at normal temperature. Accordingly, in high temperature condition, the meniscus of ink is infrequently vibrated.

As described above, in the sixth embodiment, the vibrating period Ts and the vibrating ratio $\alpha$ are determined depending on ambient temperature. Because of this, a fine vibration, appropriately set up dependent on ambient temperature, is applied to the meniscus of ink, thereby effectively suppressing the viscosity increase. In high temperature condition, a saturation vapor pressure accelerates evaporation of the solvent of ink. Accordingly, a viscosity of ink will be increased. In this connection, it is noted that the sixth embodiment adjusts a frequency of applying the fine vibration to the ink meniscus in accordance with ambient temperature. Accordingly, this embodiment is capable of efficiently applying the fine vibration to the ink meniscus, and achieving the remarkable suppression of the ink viscosity increase and the stabilization of the flying path of the ejected ink drop.

A seventh embodiment of the present invention will be described with reference to FIGS. 21 and 22. A feature of the seventh embodiment resides in that a vibrating period Ts and a vibrating rate $\alpha$ are determined depending on a viscosity of ink contained in an ink cartridge.

Figure 21:
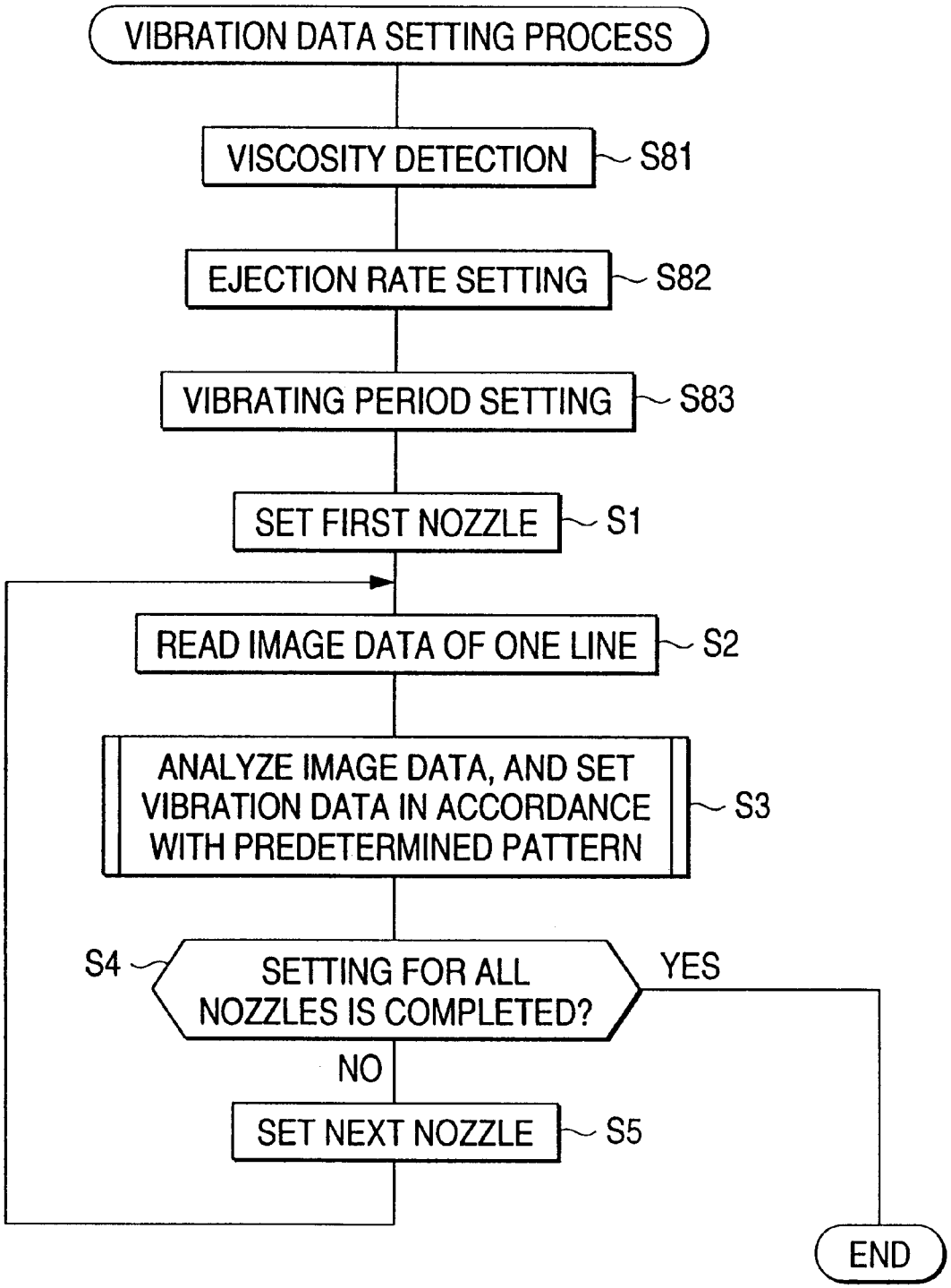
FIG. 21 is a flow chart showing a vibration data setting step according to a seventh embodiment of the present invention.

FIG. 21 is a flow chart showing a vibration data setting process according to the seventh embodiment of the present invention. The vibration data setting process of this embodiment uses steps S81 to S83 in place of the steps S71 to S73. In the flow chart, a viscosity of ink contained in an ink cartridge is detected (S81), and the controller determines a viscosity rate $\alpha$ (S82) and a vibrating period Ts (S83), while referring to maps to be described later.

Figure 22:
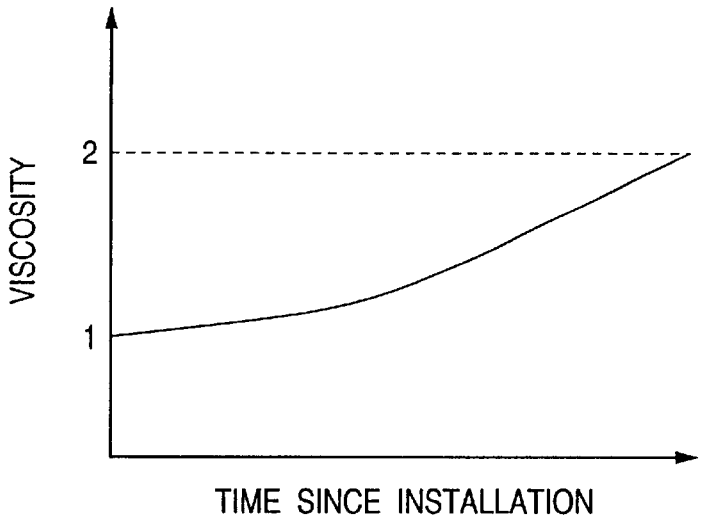
FIG. 22(*a*) is a diagram for explaining a relation between a time since installation and an ink viscosity, FIGS. 22(*b*) and (*c*) show a reference map for the vibrating ratio and a reference map for the vibrating period, respectively in connection with the time since installation.
Figure 22:
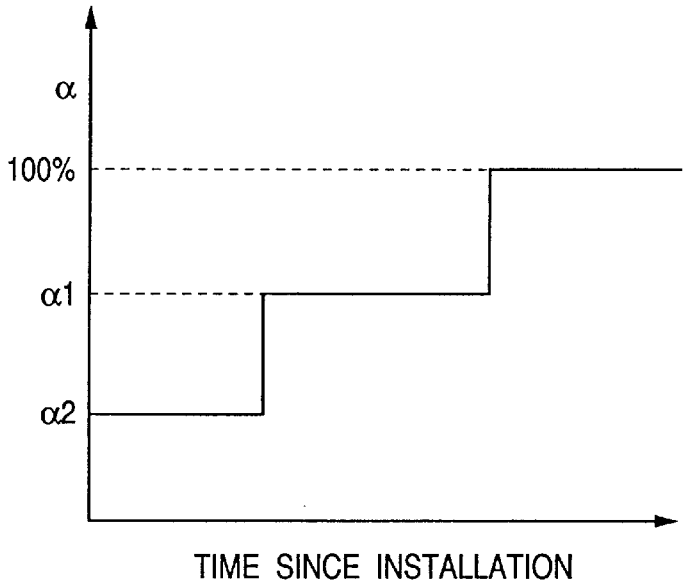
Figure 22:
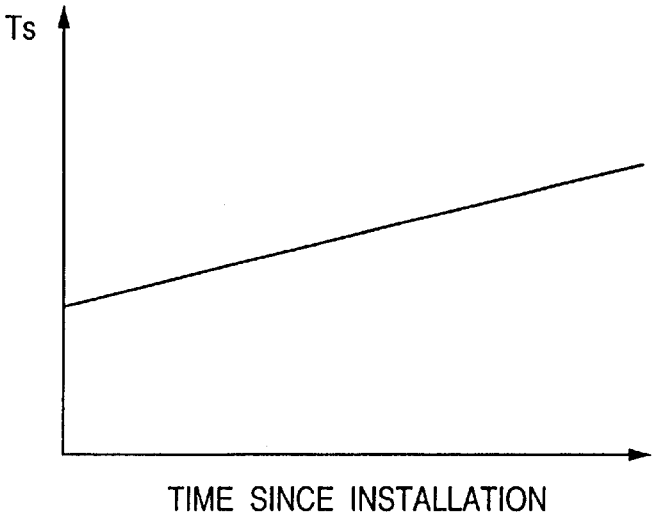

FIG. 22(*a*) shows a relationship between the ink viscosity and time since installation of cartridge. A general ink cartridge has such a nature as to permit water vapor to transmit therethrough (some material of the cartridge rejects the transmission of the water vapor, therethrough as a matter of course). Accordingly, after a new ink cartridge is installed to the printer, a viscosity of ink gradually decreases with time elapsing thereafter. A reference map for the ink viscosity as shown in FIG. 22(*a*) may be prepared by measuring empirically a variation of the ink viscosity with the time since installation. The present viscosity of ink may be estimated by applying an elapsing time after the cartridge is set to the printer to the reference map of FIG. 22(*a*).

A reference map for the vibrating rate stored in a proper memory is depicted as shown in FIG. 22(*b*). As shown, the rate stepwise increases with time since installation of cartridge. A reference map for the vibrating period is depicted as shown in FIG. 22(*c*). As shown, the vibrating period Ts linearly increases with the time since installation of cartridge. Therefore, with increase of the ink viscosity, the vibrating period Ts and the viscosity rate $\alpha$ increase, to thereby increase a frequency of applying the fine vibration to the ink meniscus.

As described above, the seventh embodiment determines the vibrating period Ts and the viscosity rate $\alpha$ depending on a viscosity of ink contained in the ink cartridge, and hence has useful effects comparable with those of the sixth embodiment.

Figure 25:
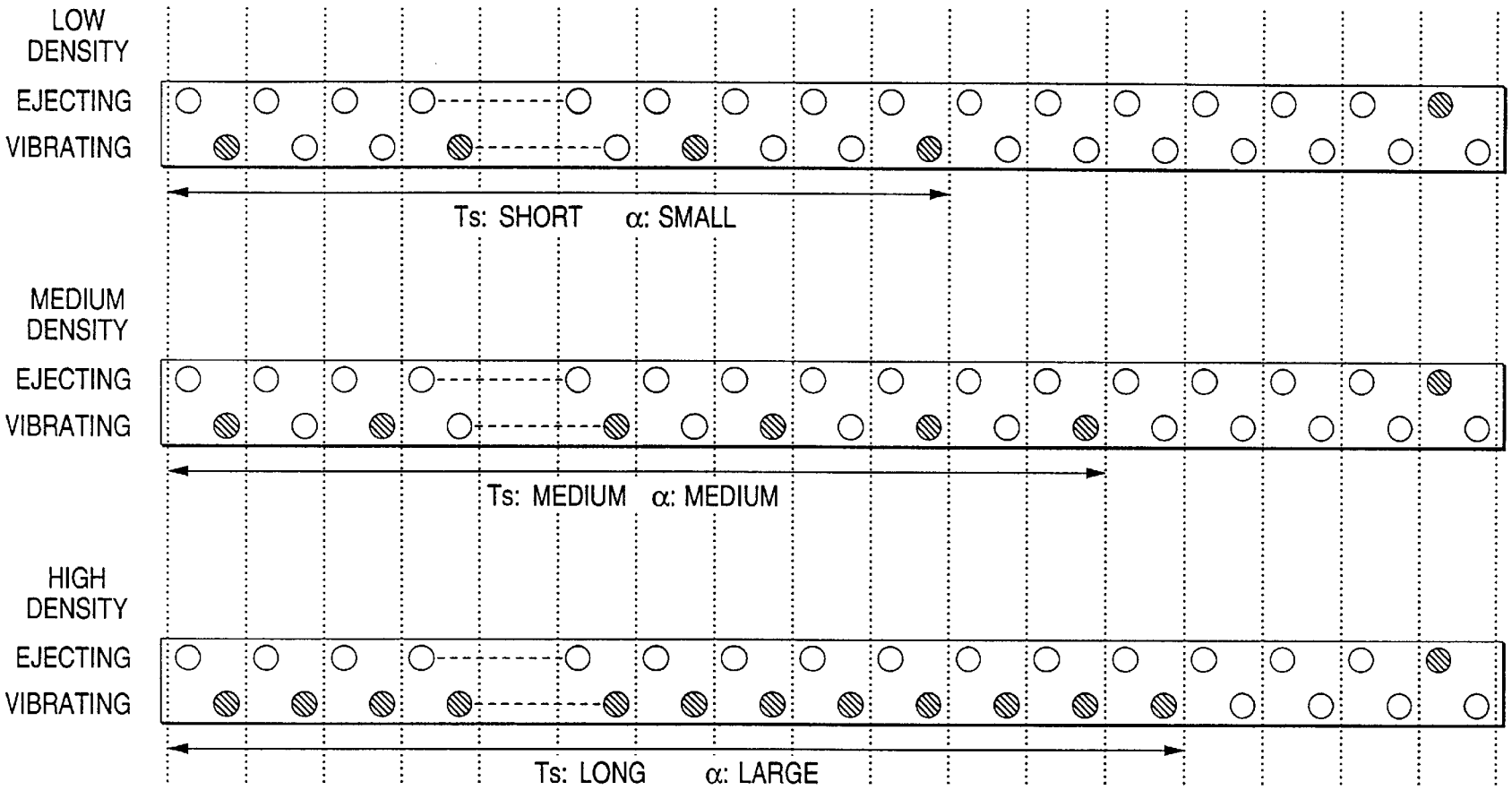
FIG. 25 is an explanatory diagram showing how the vibration data is set in the vibration data setting step of FIG. 23.

An eighth embodiment of the present invention will be described with reference to FIGS. 23 to 25. A feature of the eighth embodiment resides in that a vibrating period Ts and a vibrating rate $\alpha$ are determined depending on a solid content density of ink.

Figure 23:
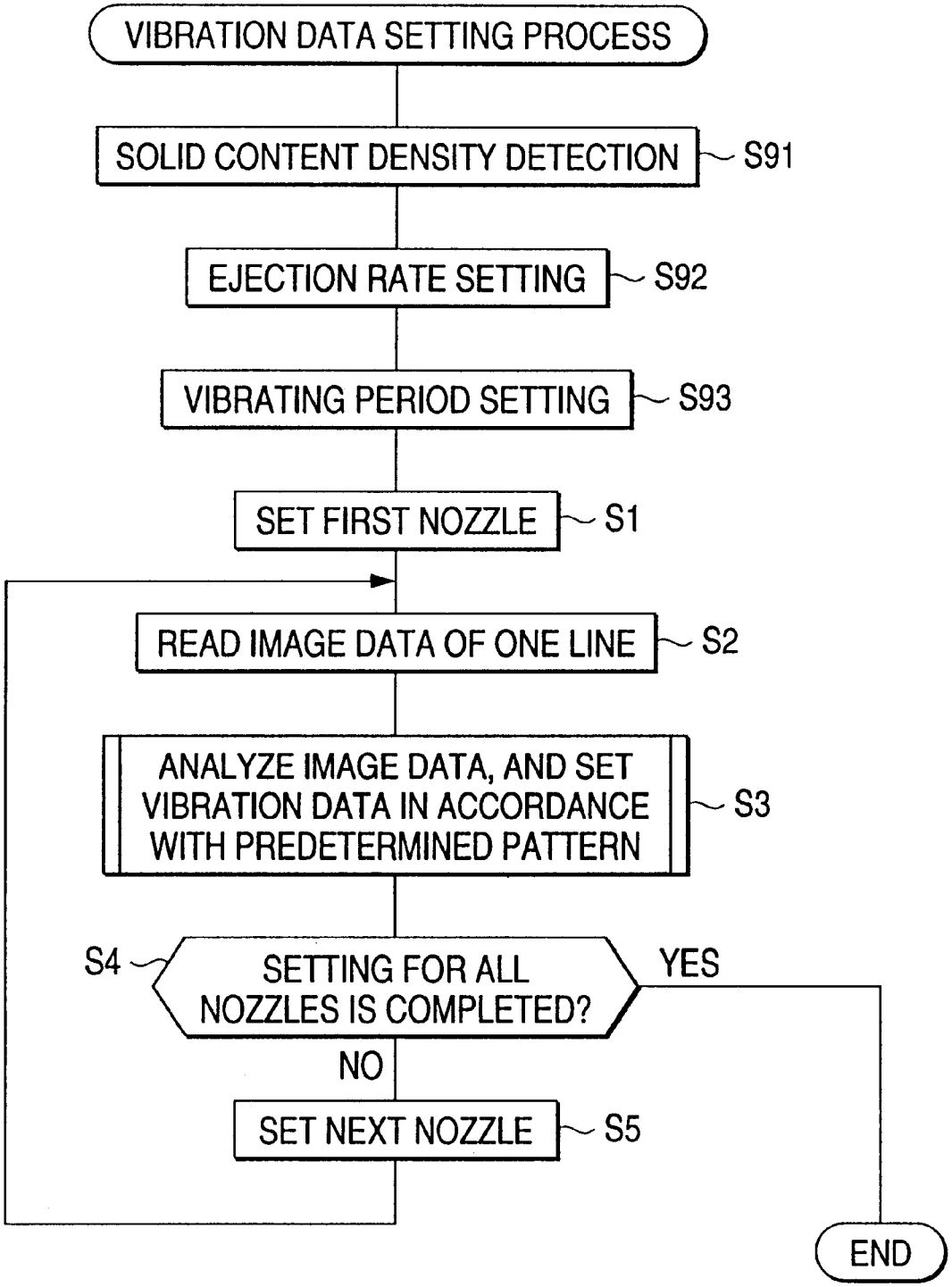
FIG. 23 is a flow chart showing a vibration data setting step according to an eighth embodiment of the present invention.

FIG. 23 is a flow chart showing a vibration data setting process according to the eighth embodiment of the present invention. In the flow chart, the eighth embodiment uses steps S91 to S93 in place of the steps S81 to S83 in the flow chart of FIG. 21. A solid content density of each of color inks is detected (S91). The solid content densities of the color inks are different from each other. The controller determines a rate α (S92) and a vibrating period Ts (S93) by applying the detected solid content densities to maps to be described later.

FIG. 24(*a*) is a table showing relationships between the solid content density and the color of ink. In the table shown in FIG. 24(*a*), the solid content densities are set at high, medium and low respectively for ink colors. The high density is assigned to black ink; the medium density is assigned to a group of cyan and magenta; and the low density is assigned to a group of yellow, light cyan and light magenta. Light cyan and light magenta are brighter than cyan and magenta. In the color ink jet printer, recording heads are provided respectively for the ejection of the color inks. Therefore, the solid content density is prepared for each color head.

A rate map stored in a proper memory is shown in FIG. 24(*b*). As shown, a rate α is stepwise increased with the solid content density. A period map stored in a related memory is shown in FIG. 24(*c*). The vibrating period Ts is also stepwise increased with the solid content density. Accordingly, with increase of the solid content density, the vibrating period Ts and the rate α are increased, to thereby increase a frequency of applying the fine vibration to the ink meniscus.

In the eighth embodiment, the vibrating period Ts and the rate α are determined depending on the solid content densities of the color inks. Therefore, as shown in FIG. 25, fine vibrations appropriately selected in accordance with the solid content densities of the color inks are applied to the ink meniscus. Since the solid content density is prepared for each color ink, there is no need of using density sensors. Accordingly, great suppression of the viscosity increase, stabilization of the flying path of the ink drop, and efficient flushing may be achieved without complexity of the whole machine construction.

A ninth embodiment of the present invention will be described with reference to FIGS. 26 and 27. A feature of the ninth embodiment resides in that a plurality of vibration data setting processes of the embodiments already described are used.

Figure 26:
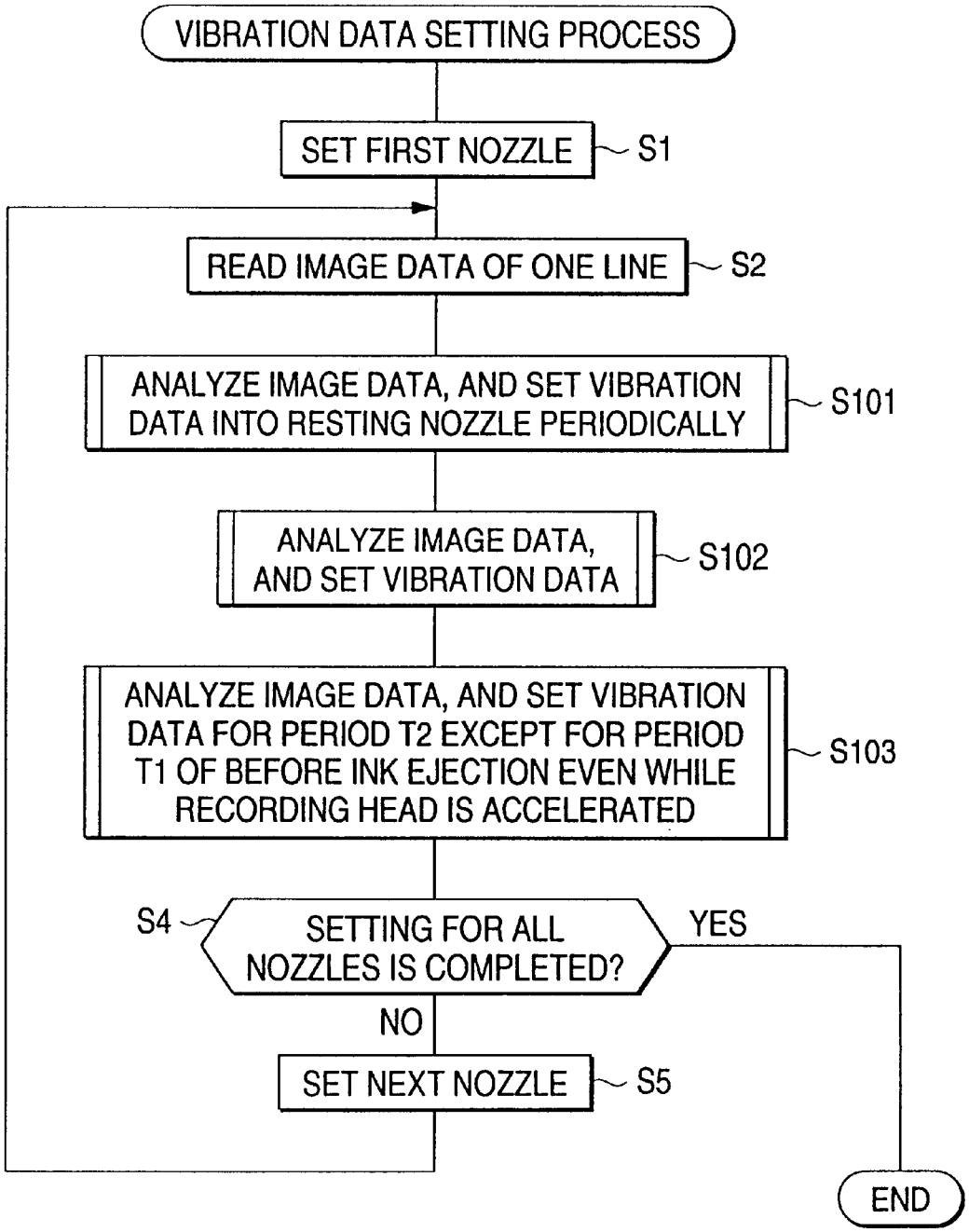
FIG. 26 is a flow chart showing a vibration data setting step according to a ninth embodiment of the present invention.

FIG. 26 is a flow chart showing a vibration data setting process according to the ninth embodiment of the present invention. In this embodiment, three vibrating patterns of the vibration data are used on the basis of analyzing image data of one print line. In the flow chart, in a step S101, when a nozzle being in a state of rest is detected, fine vibrations is periodically made valid (the vibration data are periodically set to "1"s), as described in the fifth embodiment (the fourth vibrating pattern). In a step S102, when a first period T3 elapses from the ink ejection, the vibration data is set to "1"s only during a second period T4, as described in the fourth embodiment (the third vibrating pattern). In a step S103, as in the third embodiment, application of the vibration data is extended to the accelerating region where the recording head 20 is accelerated. The vibration data is not applied to the ink meniscus during the first period T1 preceding to the printing period where the ink drop is ejected, and is applied to the meniscus during the second period T2 preceding to the first period T1, as described in the second embodiment (the second vibrating pattern).

Figure 27:
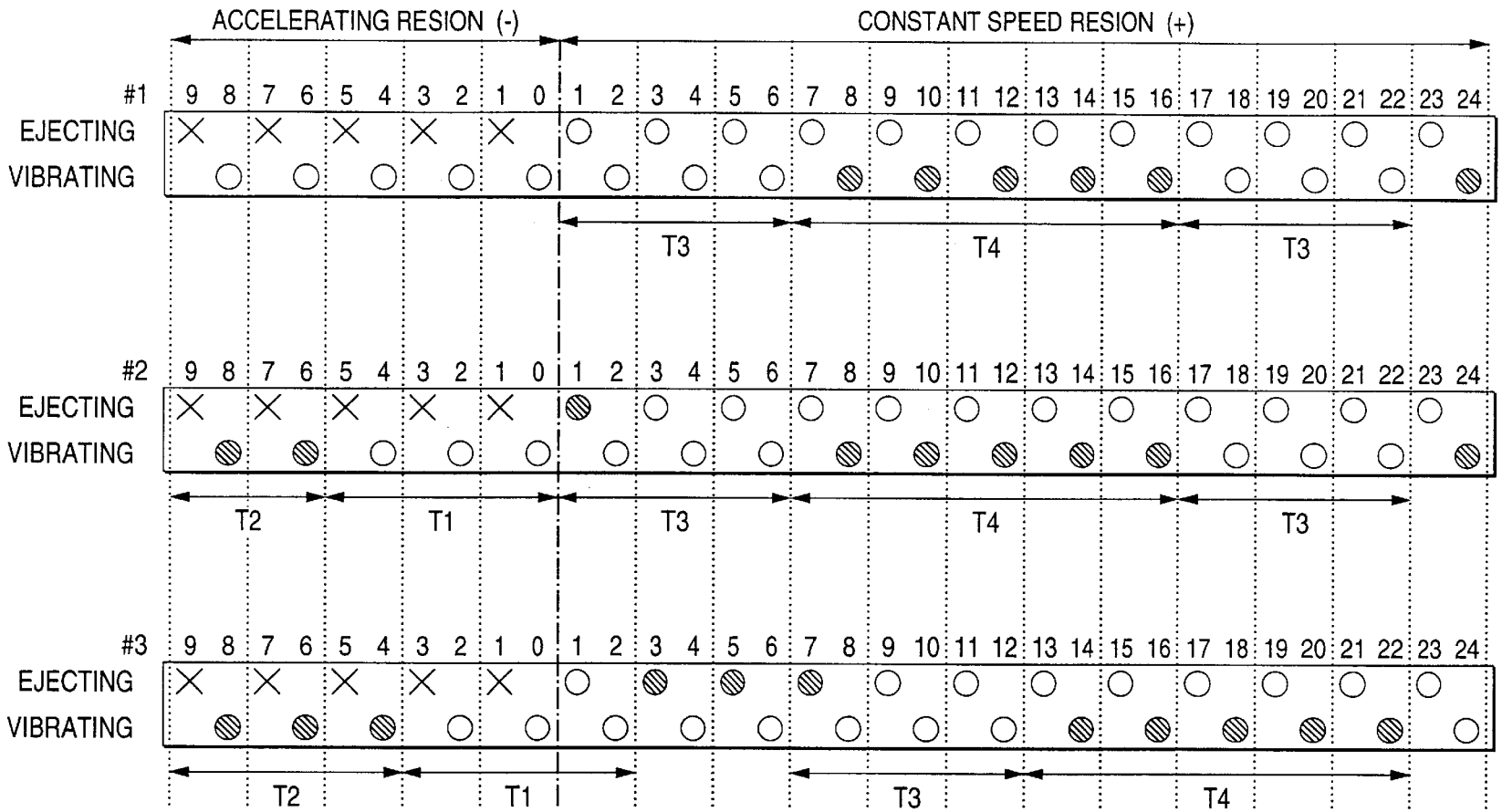
FIG. 27 is an explanatory diagram showing how the vibration data is set in the vibration data setting step of FIG. 26.

FIG. 27 is a diagram useful in explaining a vibration data setting process of the ninth embodiment. Since the nozzle #1 is at rest, a periodical fine vibration is applied to the meniscus of the ink in this nozzle. The nozzles #2 and #3 (precisely the ink meniscuses therein) are subjected to fine vibrations according to the second and third vibrating patterns. Thus, the ninth embodiment appropriately applies fine vibrations to the meniscus of each nozzle in accordance with operating conditions of the nozzle.

Figure 28:
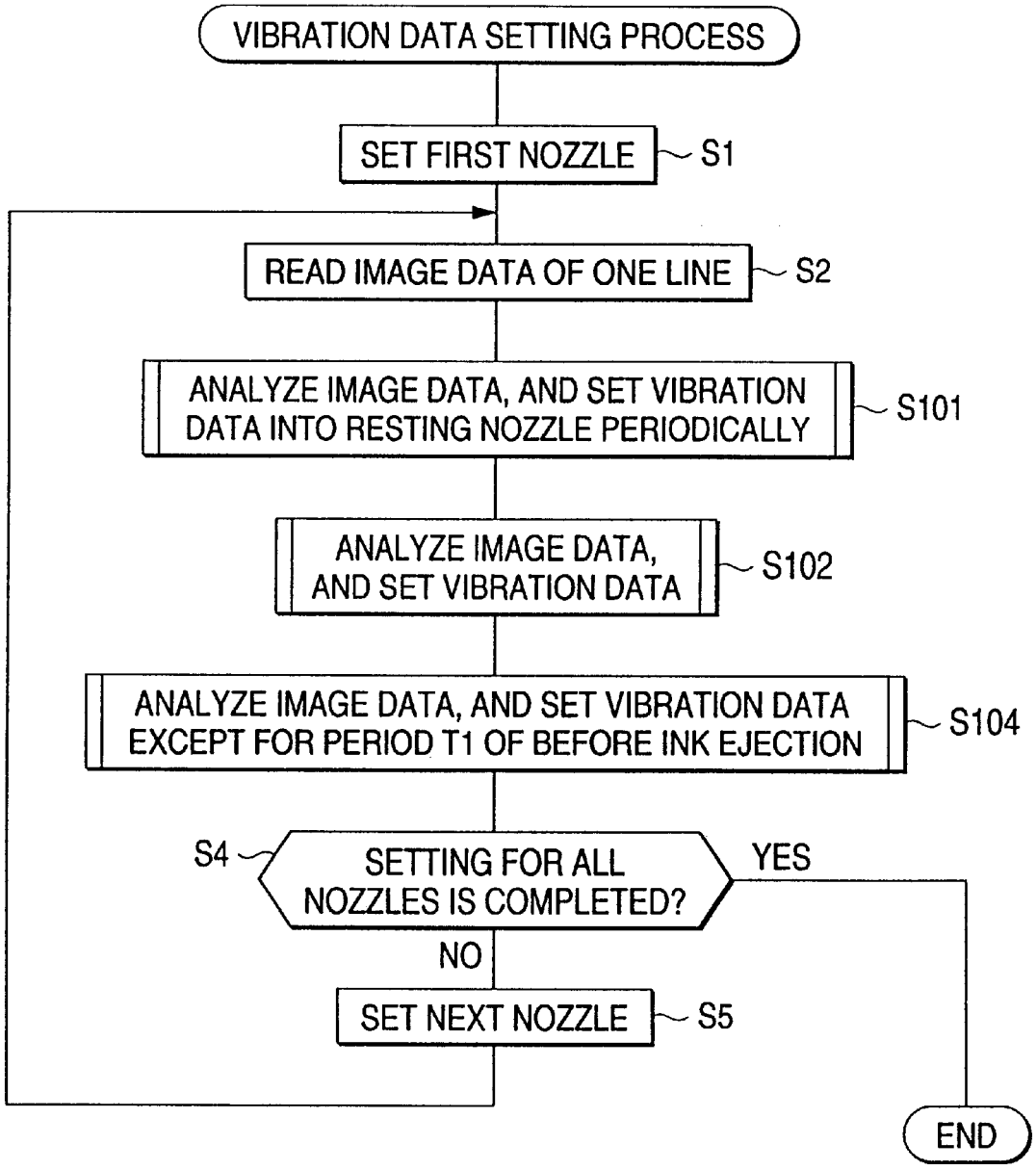
FIG. 28 is a flow chart showing a vibration data setting step according to a tenth embodiment of the present invention.
Figure 29:
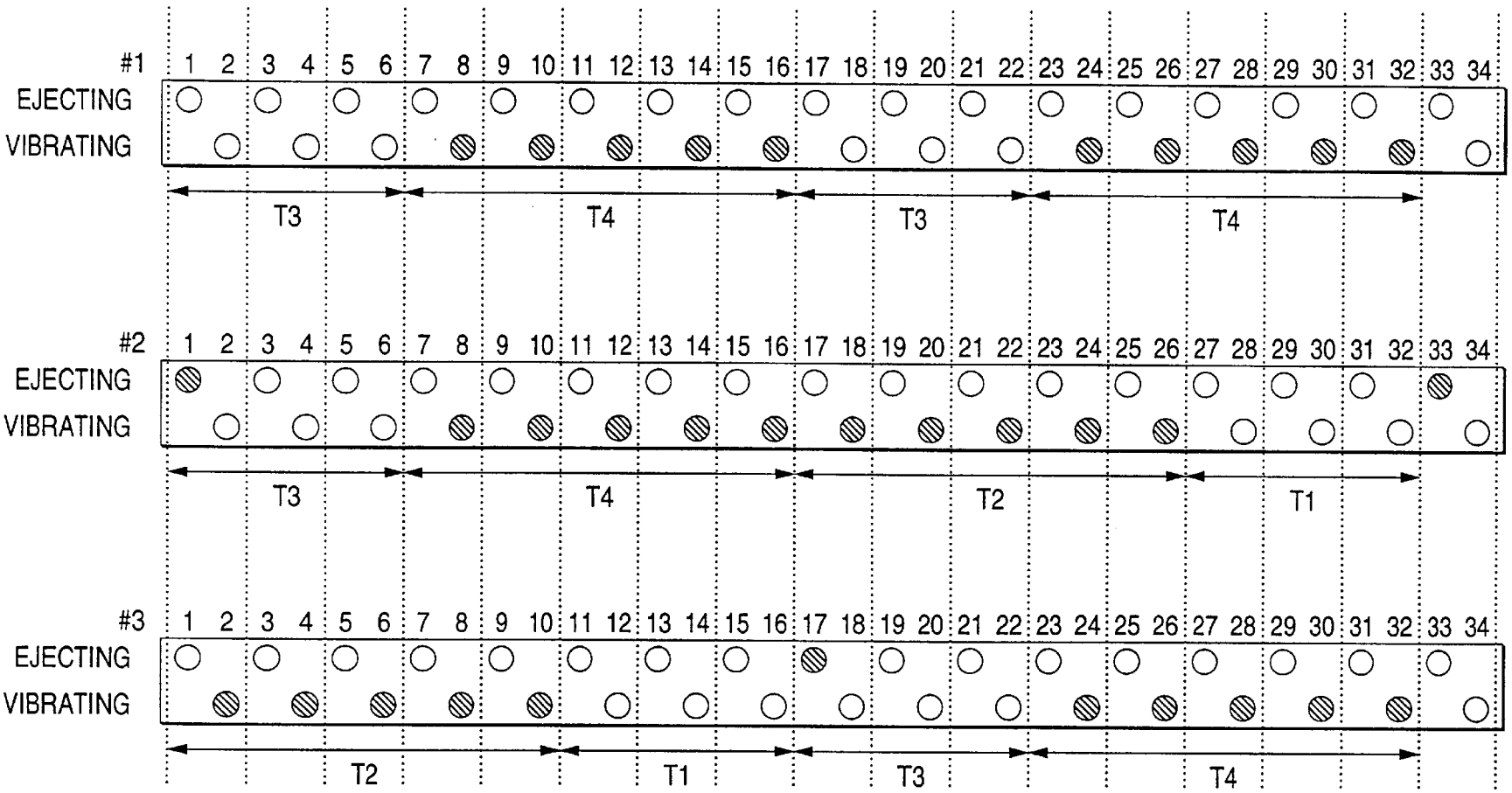
FIG. 29 is an explanatory diagram showing how the vibration data is set in the vibration data setting step of FIG. 28.

A tenth embodiment of the present invention will be described with reference to FIGS. 28 and 29. FIG. 28 is a flow chart showing a vibration data setting process according to the tenth embodiment of the present invention. As shown, the vibration data setting process uses a step S104 in place of the step S103 in FIG. 26. In the step S104, the controller makes the vibration data valid during a time period except a time period T1 preceding to a printing period where the ink is ejected, as described in the first embodiment (first vibrating pattern). Therefore, the tenth embodiment has useful effects comparable with those of the ninth embodiment.

While the present invention has been described using specific embodiments, it is readily understood that the present invention is not limited to those embodiments but may be modified, altered and changed within the true spirits of the present invention. The time periods T1 to T4 used in the above-mentioned embodiments are used merely as typical examples. Numerals used in those embodiments are used for indicate preferable values.

Figure 30:
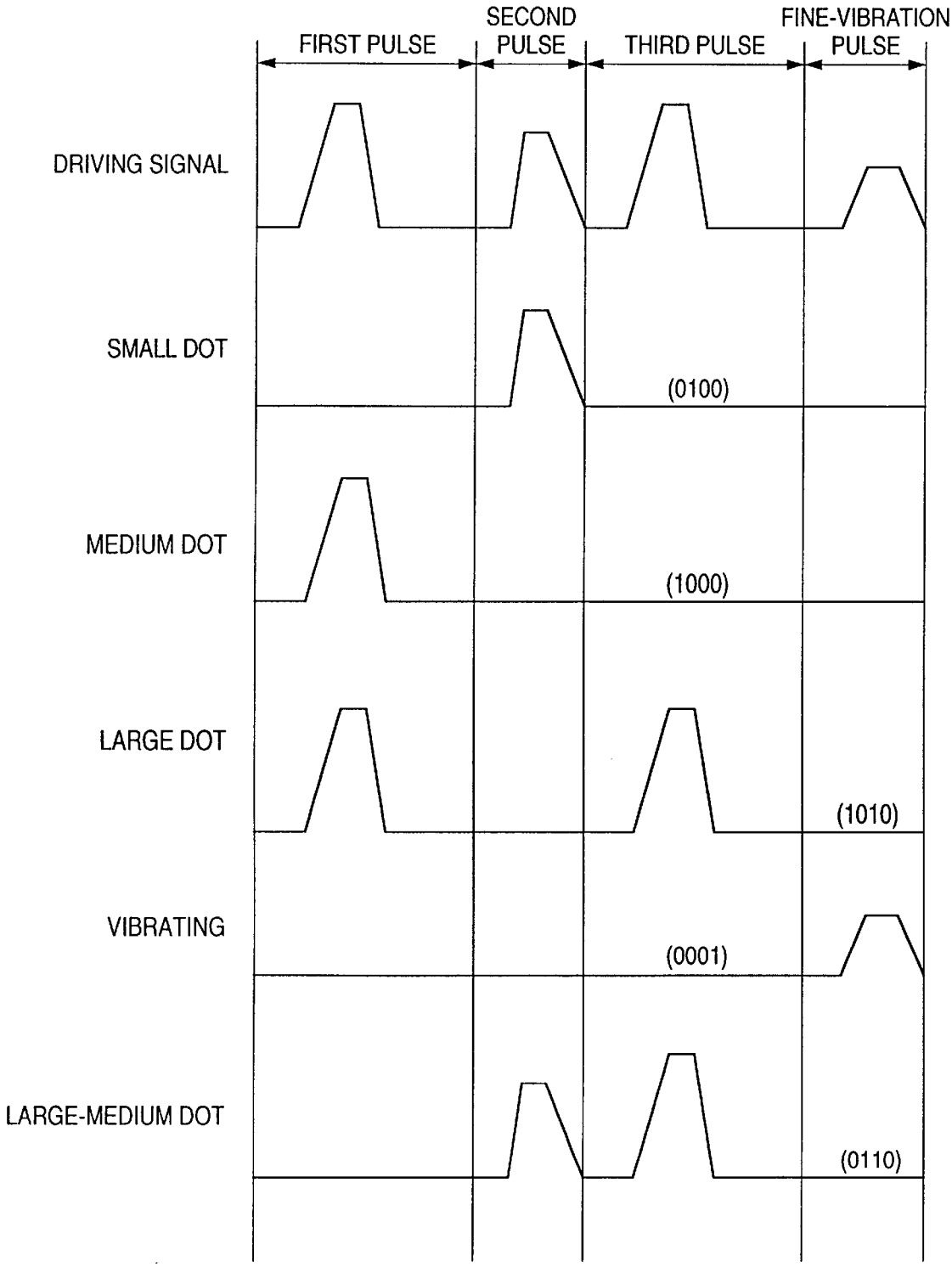
FIG. 30 is a waveform diagram showing a first modification of the driving signal of FIG. 5.
Figure 31:
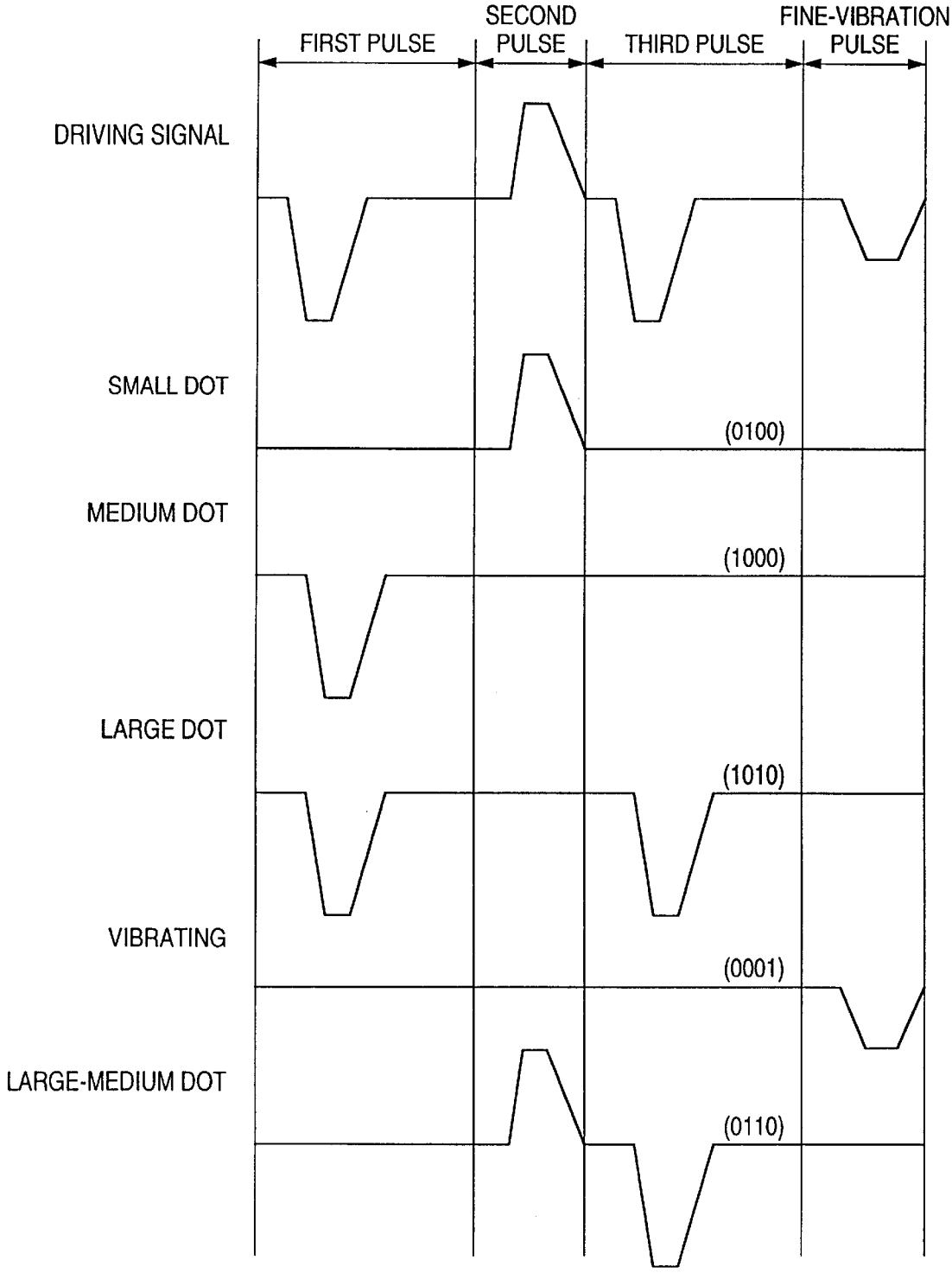
FIG. 31 is a waveform diagram showing a second modification of the driving signal of FIG. 5.

A modification of the first embodiment is shown in FIG. 30. As shown, a driving signal for printing may consist of a plurality of driving pulse components. In the figure, first and third pulse components are used for ejecting ink drops of medium size, and a second driving pulse component is for ejecting an ink drop of small size. Those pulses, when properly combined, are capable of producing ink drops of four different sizes.

A second modification of the first embodiment is shown in FIG. 30. In this modification, one of the pulses contained in a driving signal may be inverted in polarity. It is evident that the waveform of the driving signal may be configured to have any other suitable waveforms than those of the embodiment and modifications.

The following modification is also allowed: programs executing processing designated by the respective flow charts are stored in a data recording medium, or a storage device, and are read out therefrom by a computer incorporated into the printer.

As has been described heretofore, according to an ink jet recording apparatus and an ink jet recording method of the present invention, dot pattern data is generated by determining the printing period where the fine vibration should be applied to the meniscus of ink in each nozzle in accordance with analysis of the print data. Accordingly, remarkable suppression of the viscosity increase, stabilization of the flying path of the ink drop, and efficient flushing may be achieved without complexity of the whole machine construction.

In conclusion, the present invention can be expressed as follows:

1. An ink jet recording apparatus, wherein a predetermined period (or a first period) preceding to the ink ejection is longer than a time period taken until a pressure variation caused by the application of fine vibration damps to zero.
2. An ink jet recording apparatus, wherein the period for vibrating ink is set such that it is decreased as ambient temperature becomes high.

3. An ink jet recording apparatus, wherein the rate for vibrating ink is set such that it is decreased as ambient temperature becomes high.
4. An ink jet recording apparatus, wherein the period for vibrating ink is set such that it is increased as a viscosity of the ink becomes high.
5. An ink jet recording apparatus, wherein the rate for vibrating ink is set such that it is increased as a viscosity of the ink becomes high.
6. An ink jet recording apparatus, wherein the period for vibrating ink is set such that it is increased as a solid content density of the ink becomes high.
7. An ink jet recording apparatus, wherein the rate for vibrating ink is set such that it is increased as a solid content density of the ink becomes high.

What is claimed is:

1. An ink jet apparatus comprising:

a recording head provided with nozzles each from which an ink drop is ejected by operating associated pressure generating elements in accordance with inputted print data;

driving signal generating means for generating a first driving signal and a second driving signal, the first driving signal for operating the pressure generating element so as to eject the ink drop, the second driving signal for operating the pressure generating element such an extent as to not eject the ink drop;

data generating means for analyzing an operating condition of each nozzle which indicates which printing period the ink drop is to be ejected among all printing periods contained in the print data, and for selecting at least one predetermined operation pattern for operating the pressure generating element in accordance with the analyzed operating condition in order to generate a dot pattern data in which first data and second data are arranged in accordance with the selected pattern, the first data being associated with the first driving signal and the second data being associated with the second driving signal and switching means for inputting the first and second driving signals to the pressure generating element in accordance with the dot pattern data for each printing period.

2. The ink jet recording head as set forth in claim 1, wherein the predetermined operation pattern includes a first operation pattern for generating the dot pattern data in which the second data is set so as to select the second driving signal at a predetermined frequency in the printing period except for a predetermined period preceding to a printing period where the first driving signal is selected.

3. The ink jet recording head as set forth in claim 1, wherein the predetermined operation pattern includes a second operation pattern for generating the dot pattern data in which the second data is not set for a first period preceding to a printing period where the first driving signal is selected, and the second data is set so as to select the second driving signal at a predetermined frequency for a second period preceding to the first period.

4. The ink jet recording head as set for the in claim 3, wherein the first period and the second period are set even in an accelerating region where the recording head is accelerateadly moved.

5. The ink jet recording head as set forth in claim 1, wherein the predetermined operation pattern includes a third operation pattern for generating the dot pattern data in which the second data is not set for a first period subsequent to a printing period where the first driving signal is selected, and the second data is set so as to select the second driving signal at a predetermined frequency for a second period subsequent to the first period.

6. The ink jet recording head as set forth in claim 1, wherein the predetermined operation pattern includes a fourth operation pattern for generating the dot pattern data in which the second data is set so as to periodically select the second driving signal at a predetermined frequency with respect to a nozzle of which no ink drop is ejected within one main scanning.

7. The ink jet recording head as set forth in any of claims 2 to 6, wherein at least one of the predetermined frequency and the period of which the second data is set is variably determined according to ambient temperature.

8. The ink jet recording head as set forth in claim 7, wherein the longer period is set in accordance with the lower ambient temperature.

9. The ink jet recording head as set forth in claim 7, wherein the higher frequency is set in accordance with the lower ambient temperature.

10. The ink jet recording head as set forth in any of claims 2 to 6, wherein at least one of the predetermined frequency and the period of which the second data is set is variably determined according to a viscosity of the ink.

11. The ink jet recording head as set forth in claim 10, wherein the longer period is set in accordance with longer time since installation of an ink cartridge.

12. The ink jet recording head as set forth in claim 10, wherein the higher frequency is set in accordance with longer time since installation of an ink cartridge.

13. The ink jet recording head as set forth in any of claims 2 to 6, wherein at least one of the predetermined frequency and the period of which the second data is set is variably determined according to a solid content density of the ink.

14. The ink jet recording head as set forth in claim 13, wherein the longer period is set in accordance with the higher solid content density.

15. The ink jet recording head as set forth in claim 13, wherein the higher frequency is set in accordance with the higher solid content density.

16. The ink jet recording head as set forth in claim 1, wherein the pressure generating element is a piezoelectric vibrator.

17. The ink jet recording head as set forth in claim 1, wherein the second driving signal operates the pressure generating element so as to vibrate finely.

18. An ink jet recording method for operating a pressure generating element to eject an ink drop from each of nozzles provided in a recording head, comprising the steps of analyzing an operation condition of each nozzle which indicates which printing period the ink drop is to be ejected among all printing periods contained in inputted print data;

selecting at least one predetermined operation pattern in accordance with the analyzed operation condition;

generating a dot pattern data in which a fine-vibration data for operating the pressure generating element such an extent as to not eject the ink drop is set at a predetermined position therein; and inputting the dot pattern data into the pressure generating element.

19. A computer-readable recording medium including a computer program for causing an ink jet recording apparatus, which comprises a pressure generating element operated to eject an ink drop from each of nozzles provided in a recording head, to execute the functions of:

analyzing an operation condition of each nozzle which indicates which printing period the ink drop is to be ejected among all printing periods contained in inputted print data;

selecting at least one predetermined operation pattern in accordance with the analyzed operation condition;

generating a dot pattern data in which a fine-vibration data for operating the pressure generating element such an extent as to not eject the ink drop is set at a predetermined position therein; and inputting the dot pattern data into the pressure generating element.

* * * * *